United States Patent [19]

Klayman

[11] Patent Number: 4,748,669

[45] Date of Patent: May 31, 1988

[54] STEREO ENHANCEMENT SYSTEM

[75] Inventor: Arnold I. Klayman, Huntington Beach, Calif.

[73] Assignee: Hughes Aircraft Company, Los Angeles, Calif.

[21] Appl. No.: 929,452

[22] Filed: Nov. 12, 1986

Related U.S. Application Data

[63] Continuation-in-part of Ser. No. 844,929, Mar. 27, 1986, abandoned.

[51] Int. Cl.[4] ..... H04S 1/00

[52] U.S. Cl. ..... 381/1; 381/66; 381/25; 381/98; 381/103; 369/86

[58] Field of Search ..... 381/1, 27, 25, 17, 18, 381/63, 66, 103, 106, 98; 369/5, 87, 86

[56] References Cited

U.S. PATENT DOCUMENTS

| | | | |
|---|---|---|---|
| 3,170,991 | 2/1965 | Glasgal . | |
| 3,229,038 | 1/1966 | Richter . | |
| 3,238,304 | 3/1966 | Yaita et al. . | |
| 3,246,081 | 4/1966 | Edwards . | |
| 3,725,586 | 4/1973 | Iida . | |
| 3,772,479 | 11/1973 | Hilbert . | |
| 3,860,951 | 1/1975 | Camras . | |
| 3,883,692 | 5/1975 | Tsurushima . | |
| 3,911,220 | 10/1975 | Tsurushima . | |
| 3,916,104 | 10/1975 | Anazawa et al. . | |
| 3,925,615 | 12/1975 | Nakano . | |
| 3,943,293 | 3/1976 | Bailey . | |
| 3,944,748 | 3/1976 | Kuhn . | |
| 3,989,897 | 11/1976 | Carver . | |
| 4,024,344 | 5/1977 | Dolby et al. | 381/27 |
| 4,027,101 | 5/1977 | DeFreitas et al. . | |
| 4,030,342 | 6/1977 | Bond et al. . | |
| 4,063,034 | 12/1977 | Peters . | |
| 4,069,394 | 1/1978 | Doi et al. . | |
| 4,085,291 | 4/1978 | Cooper . | |
| 4,087,629 | 5/1978 | Atoji et al. . | |
| 4,087,631 | 5/1978 | Yamada et al. . | |
| 4,097,689 | 6/1978 | Yamada et al. . | |
| 4,118,599 | 10/1978 | Iwahara et al. . | |
| 4,135,158 | 1/1979 | Parmet . | |
| 4,139,728 | 2/1979 | Haramoto et al. . | |

(List continued on next page.)

FOREIGN PATENT DOCUMENTS 0097982 6/1983 European Pat. Off. .

OTHER PUBLICATIONS

"Some Factors Affecting the Performance of Airline (List continued on next page.)

*Primary Examiner*—Forester W. Isen

*Attorney, Agent, or Firm*—Joseph E. Szabo; Anthony W. Karambelas

[57] ABSTRACT

A stereo enhancement system (300) is disclosed which provides an enhanced wider stereo image and a wider listening area, and further provides perspective correction for achieving correct stereo sound perspective with speakers at different locations and with headphones. The stereo enhancement system includes a stereo image enhancement system (100, 10, 110) which includes circuitry (11, 13, 111, 113) for generating sum and difference signals based on left and right stereo signals, circuitry (17, 18, 19, 22, 30, 115, 125, 129, 40) for selectively altering the relative amplitudes of the difference signal components, circuitry (17, 21, 30, 117, 127, 40) for selectively altering the relative amplitudes of the sum signal components, and circuitry (23, 25, 27, 119, 121, 123) for combining the processed sum and difference signals with the original left and right stereo signals to produce enhanced left and right stereo signals. The enhancement system further includes a perspective correction system (200, 210) which is responsive to the enhanced left and right signals provided by the stereo image enhancement system or to left and right stereo signals of an audio system. The perspective correction system includes circuitry (211, 213) for generating sum and difference signals from the left and right stereo signals, equalization circuitry (215, 217, 221, 223) for providing fixed equalization for the sum and difference signals to compensate for the variation with direction of the frequency response of the human ear, and mixing circuitry (225) for combining the equalized sum and difference signals to produce left and right signals.

159 Claims, 10 Drawing Sheets

U.S. PATENT DOCUMENTS 4,562,487 12/1985 Hurst et al. .
4,567,607 1/1986 Bruney et al. .
4,599,611 7/1986 Bowker et al. .
4,683,496 7/1987 Tom .
4,149,031 4/1979 Cooper .
4,149,036 4/1979 Okamoto et al. .
4,152,542 1/1979 Cooper .
4,162,457 7/1979 Grodinsky .
4,185,239 1/1980 Filloux .
4,188,504 2/1980 Kasuga et al. .
4,192,969 3/1980 Iwahara .
4,204,092 5/1980 Bruney .
4,208,546 6/1980 Laupman .
4,209,665 6/1980 Iwahara .
4,214,267 7/1980 Roese .
4,218,585 8/1980 Carver .
4,219,696 8/1980 Kogure et al. .
4,239,937 12/1980 Kampmann .
4,239,939 12/1980 Griffis .
4,251,688 2/1981 Furner .
4,268,915 5/1981 Parmet .
4,303,800 12/1981 DeFreitas .
4,308,423 12/1981 Cohen .
4,308,426 12/1981 Kikuchi .
4,309,570 1/1982 Carver .
4,316,058 2/1982 Christensen .
4,329,544 2/1982 Yamada .
4,334,740 6/1982 Wray .
4,349,698 9/1982 Iwahara .
4,352,953 10/1982 Emmer .
4,355,203 10/1982 Cohen .
4,356,349 10/1982 Robinson ..... 381/1
4,388,494 6/1983 Schone et al. .
4,393,270 7/1983 Van den Berg .
4,394,536 9/1983 Shima et al. .
4,394,537 7/1983 Shima et al. .
4,446,488 5/1984 Suzuki .
4,489,432 12/1984 Polk ..... 381/24
4,495,637 1/1985 Bruney .
4,503,554 3/1985 Davis ..... 381/1
4,546,389 10/1985 Gibson et al. .
4,549,228 10/1985 Dieterich .
4,551,770 11/1985 Palmer et al. .
4,553,176 11/1985 Mendrala .

OTHER PUBLICATIONS

Entertainment Headsets," Gilman, J. Audio Eng. Soc., vol. 31, No. 12, pp. 914–920, Dec., 1983.
"The New Featherweight Headphones" Stock, Audio, pp. 30–32, May, 1981.
"The Acoustics of the Singing Voice," (1977) Sundberg, The Physics of Music, Scientific American Inc.
"The Loudspeaker/Living Room System," Allison, Audio, pp. 18–22, Nov., 1971.
"How We Hear Direction," Vaughan, *Audio*, pp. 50–55, Dec., 1983.
Sound and Hearing, Time, Inc., pp. 98–106, Reprinted 1971.

STEREO ENHANCEMENT SYSTEM

This application is a continuation-in-part of my application for STEREO ENHANCEMENT SYSTEM filed Mar. 27, 1986, Ser. No. 844,929, abandoned.

BACKGROUND OF THE INVENTION

The disclosed invention generally relates to an enhancement system for stereo sound reproduction systems, and is particularly directed to a stereo enhancement system which broadens the stereo sound image, provides for an increased stereo listening area, and provides for perspective correction for the use of speakers or headphones.

As is well known, a stereo sound reproduction system attempts to produce a sound image wherein the reproduced sounds are perceived as emanating from different locations, thereby simulating the experience of a live performance. The aural illusion of a stereo sound image is generally perceived as being between the speakers, and the width of the stereo image depends to a large extent on the similarity or dissimilarity between the information respectively provided to the left and right speakers. If the information provided to each speaker is the same, then the sound image will be centered between the speakers at "center stage." In contrast, if the information provided to each speaker is different, then the extent of the sound image will spread between the two speakers.

While the general concept of stereo sound imaging is not complex, its use and implementation is more difficult. The width of the stereo sound image depends not only on the information provided to the speakers, but also on listener position. Ideally, the listener is equidistant from the speakers. With many speaker systems, as the listener gets closer to one speaker, the sound from the more distant speaker contributes less to the stereo image, and the sound is quickly perceived as emanating only from the closer speaker. This is particularly so when the information in each speaker is not very different. However, even with the listener equidistant from the speakers, the perceived sound image is generally between the physical locations of the speakers and does not extend beyond the region between the speakers.

Some known speaker systems have been designed to reduce the limitation that a listener should ideally be located equidistant between speakers. However, such speaker systems are generally complex and the resulting stereo image is still limited to the region between the physical locations of the speakers.

Another consideration in stereo reproduction is the fact that the sound transducers (typically speakers or headphones) are located at predetermined locations, and therefore provide sound emanating from such predetermined locations. However, in a live performance, the perceived sound may emanate from many directions as a result of the acoustics of the structure where the performance takes place. The human ears and brain cooperate to determine direction on the basis of different phenomena, including relative phase shift for low frequency sounds, relative intensity for sounds in the voice range, and relative time arrival for sounds having fast rise times and high frequency components.

As a result of the predetermined locations of speakers or headphones, a listener receives erroneous cues as to the directions from which the reproduced sounds are emanating. For example, for speakers located in front of the listener, sounds that should be heard from the side are heard from the front and therefore are not readily perceived as being sounds emanating from the sides. For headphones or side mounted speakers, sounds that should emanate from the front emanate from the sides. Thus, as a result of the placement of speakers or headphones, the sound perspective of a recorded performance is incorrect.

There have been numerous attempts to spread and widen the stereo image with mixed results. For example, it is known that the left and right stereo signals may be mixed to provide a difference signal (such as left minus right) and a sum signal (left plus right) which can be selectively processed and then mixed to provide processed left and right signals. Particularly, it is well known that increasing or boosting the difference signal produces a wider stereo image.

However, indiscriminately increasing the difference signal creates problems since the stronger frequency components of the difference signal tend to be concentrated in the mid-range. One problem is that the reproduced sound is very harsh and annoying since the ear has greater sensitivity to the range of about 1 KHz to about 4 KHz within the mid-range (herein called the "difference signal components of greater sensitivity"). Another problem is that the listener is limited to a position that is equidistant between speakers since the mid-range includes frequencies having wavelengths comparable to the distance between a listener'ears (which have frequencies in the range of between about 1 KHz and 2 KHz). As to such frequencies (herein called the "difference signal frequency components of increased phase sensitivity"), a slight shift in the position of the listener's head provides an annoying shift in the stereo image. Moreover, the perceived widening of the stereo image resulting from indiscriminate boosting of the difference signal is small, and is clearly not worth the attendant problems.

Some known stereo imaging systems require additional amplifiers and speakers. However, with such systems, the stereo image is limited by the placement of the speakers. Moreover, placing speakers at different locations does not necessarily provide the correct sound perspective.

With other systems, fixed or variable delays are provided. However, such delays interfere with the accuracy of the reproduced sound since whatever delays existed in the performance that was recorded are already present in the recording. Moreover, delays introduce further complexity and limit the listener's position.

There have also been attempts to correct or compensate the improper sound perspective resulting from the use of headphones. However, considerations with known headphone enhancement systems include complexity and lack of effectiveness.

SUMMARY OF THE INVENTION

It would therefore be an advantage to provide a stereo enhancement system which extends the width of the stereo sound image beyond the region between the speakers.

It would also be an advantage to provide a stereo enhancement system which does not place constraint on listening position.

Another advantage would be to provide a stereo enhancement system which provides for a stereo sound image that may be perceived over a large listening area.

Still another advantage would be to provide a stereo correction system which provides for sound perspective correction for use with speakers or headphones.

The foregoing and other features and advantages are achieved by the stereo enhancement system of the invention which includes a stereo image enhancement system for providing a wider stereo image and listening area, and a perspective correction system which provides for sound perspective correction for use with speakers or headphones. The stereo image enhancement system and the perspective correction system may be utilized in combination or individually.

In accordance with the invention, a wider stereo sound image and listening area are achieved by generating sum and difference signals based on left and right stereo signals, selectively altering the relative amplitudes of the difference signal frequencies and the relative amplitudes of the sum signal frequencies, and combining the processed sum and difference signals with the original left and right signals to produce enhanced left and right stereo signals.

Particularly, selected frequency components of the difference signal are boosted (emphasized) relative to other difference signal frequency components, and selected frequency components of the sum signal are boosted relative to other sum signal frequency components. The selective boosting of the difference signal provides for a wider stereo image and a wider listening area, and the selective boosting of the sum signal prevents the sum signal from being overwhelmed by the difference signal.

In one embodiment of the invention, a spectrum analyzed that is responsive to the difference signal controls the relative amplitudes of the difference signal frequency components so that the quieter difference signal frequency components are boosted relative to louder difference signal frequency components. The difference signal is also equalized by a fixed equalizer so that the difference signal frequencies having wavelengths comparable to the distance between a listener's ears are deemphasized. The spectrum analyzer further controls the relative amplitudes of the sum signal frequency components so that sum signal frequency components are boosted in proportion to the levels of corresponding difference signal frequency components.

In another embodiment of the invention, the difference signal is equalized with a fixed difference signal equalizer so that difference signal frequency components that statistically include quieter difference components are boosted relative to difference signal frequency components that statistically include louder difference signal frequencies. The sum signal is equalized with a fixed sum signal equalizer so that the sum signal components in the frequency range that statistically includes quieter difference signal frequency components are boosted.

As a result of the selective emphasis or boost of the difference signal components, a wider stereo image is provided, and the harshness and image shifting problems associated with indiscriminate increase of the difference signal are substantially reduced by the equalization provided by the fixed equalizer utilized by the invention. The selective emphasis or boost of the quieter difference signal components further enhances the stereo image for the following reasons. Ambient reflections and reverberant fields at a live performance are readily perceived and are not masked by the direct sounds. In a recorded performance, however, the ambient sounds are masked by the direct sounds, and are not perceived at the same level as at a live performance. The ambient sounds generally tend to be in the quieter frequencies of the difference signal, and boosting the quieter frequencies of the difference signal unmasks the ambient sounds, thereby simulating the perception of ambient sounds at a live performance.

The selective emphasis of the difference signal also provides for a wider listening area for the following reasons. The louder frequency components of the difference signal tend to be in the mid-range which includes frequencies having wavelengths comparable to the ear-to-ear distance around the head of a listener (the previously mentioned "difference signal frequency components of increased phase sensitivity"). As a result of the selective emphasis provided by the invention, the difference signal frequency components of increased phase sensitivity are not inappropriately boosted. Therefore, the stereo image shifting problem resulting from indiscriminate increase of the difference signal (discussed above in the background) is substantially reduced, and the listener is not limited to being equidistant from the speakers.

In providing the selective boosting of the difference signal, the amount of enhancement, which is determined by the level of the selectively boosted difference signal that is mixed, is automatically adjusted so that the amount of stereo provided is relatively consistent. Without such automatic adjustment, the amount of enhancement provided would have to be manually adjusted for the differing amounts of stereo in different recordings.

The process of selectively boosting the difference signal also boosts any artificial reverberation introduced in the recording process since artificial reverberation is predominantly in the difference signal. In order to avoid the inappropriate boosting of artificial reverberation, the enhancement system of the invention monitors the sum and difference signals for characteristics that indicate the possible presence of artificial reverberation. If the possibility of artificial reverberation is detected, the amount of boost provided for the difference signal is selectively reduced and the amount of boost for the sum signal is selectively increased.

A further aspect of the disclosed invention is a sound perspective correction system which provides perspective correction for recorded performances reproduced with speakers located at different positions or with headphones. The perspective correction system selectively modifies sum and difference signals derived from the left and right stereo signals so that the reproduced sounds are perceived as emanating from the directions a listener would expect at a live performance. Thus, with speakers located in front of the listener, sounds that should be heard as emanating from the sides are perceived as emanating from the sides. With headphones, sound that should be heard as emanating from the front are perceived as emanating from the front.

The sound perspective correction system achieves perspective correction by generating sum and difference signals from left and right stereo signals, providing fixed equalization for the sum and difference signals to compensate for the variation with direction of the frequency response of the human ear, and combining the equalized sum and difference signals to produce left and right signals. For speakers located in front of the listener, the difference signal is selectively boosted so that side sounds are restored to the appropriate levels that would have been perceived has they been reproduced to emanate from the sides. For speakers located to the side or for headphones, the sum signal is selectively attenuated to restore front sounds to the appropriate levels that would have been perceived had they been reproduced to emanate from the front.

As indicated previously, the sound perspective correction system of the invention may be utilized in conjunction with the above-summarized stereo image enhancement system of the invention or may be utilized alone with other audio components.

Principles of the present invention are applicable both for playback of conventional stereo phonograph records, magnetic tapes and digital discs through a conventional sound reproducing system including a pair of loudspeakers and for making unique recordings on phonograph records, digital discs or magetic tape which recordings can be played on a conventional sound reproducing system to produce left and right stereo output signals providing the advantageous effects described above.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
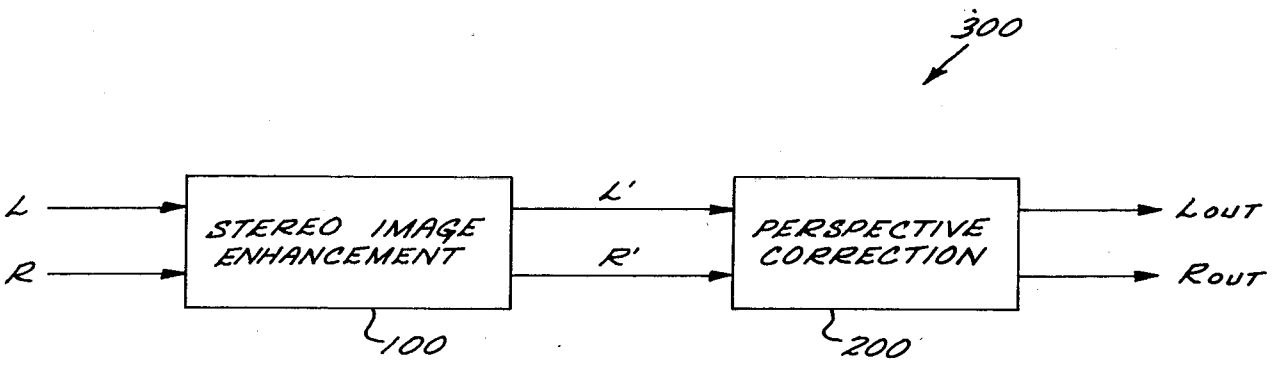
FIG. 1 is a block diagram of the stereo enhancement system of the invention.

In the following detailed description and in the several figures of the drawing, like elements are identified with like reference numerals.

In order to facilitate the understanding of the invention, the following discussion is provided in different sections, with each subsequent section being more detailed than the previous section. Thus, an overview is first presented wherein the overall functions provided are discussed. Then, the invention is discussed in more detail with more emphasis on operating parameters.

I.
OVERVIEW

Referring now to FIG. 1, shown therein is a block diagram of the stereo enhancement system 300 of the invention, which includes a stereo image enhancement system 100 and a perspective correction system 200. The stereo image enhancement system 100 receives left and right stereo signals L and R and processes such signals to provide image enhanced left and right stereo signals L′ and R′ to the perspective correction system 200. The perspective correction system 200 processes the image enhanced stereo signals to provide image enhanced stereo signals which have been corrected to provide for proper sound perspective when amplified and played through speakers or headphones.

For use with standard commercially available audio components, the stereo enhancement system 300 of the invention may be utilized in the tape monitor loop or, if available, in an external processor loop of a preamplifier. Such loops are not affected by the preamplifier controls such as tone controls, balance control, and volume control. Alternatively, the stereo enhancement system 300 may be interposed between the preamplifier and power amplifier of a standard stereo sound reproduction system. However, with such installation, the balance and tone controls are preferably disabled or nulled.

The disclosed stereo enhancement system 300 may be readily incorporated for production into audio preamplifiers that are manufactured and sold as separate units, as well as into audio preamplifiers that are included in integrated amplifiers and receivers. As so incorporated, the stereo enhancement system 100 is preferably upstream of the tone and balance controls and preferably is capable of being bypassed.

It should be noted that the enhancement provided by the disclosed stereo enhancement system 300 can be advantageously utilized to enhance recordings. Such recordings can be played back on an audio system which does not include the stereo enhancement system 300, or an audio system which does include the stereo enhancement system 300 and which has been bypassed. Thus, for example, a recording which includes image enhancement and perspective correction can be made for playback in an automobile with side mounted speakers. It should be noted that perspective correction may not be desired in making recordings unless the playback conditions are known, e.g., that playback will be only through side mounted automobile speakers.

It should also be noted that the stereo image enhancement system 100 and/or the perspective correction 200 may be utilized independently in an audio system. Thus, for example, the perspective correction system 200 alone may be incorporated into an automobile audio system for correcting the improper sound perspective caused by side mounted speakers. Also, for cost considerations, the stereo image enhancement system 100 alone may be incorporated in an audio system for home use.

Figure 2:
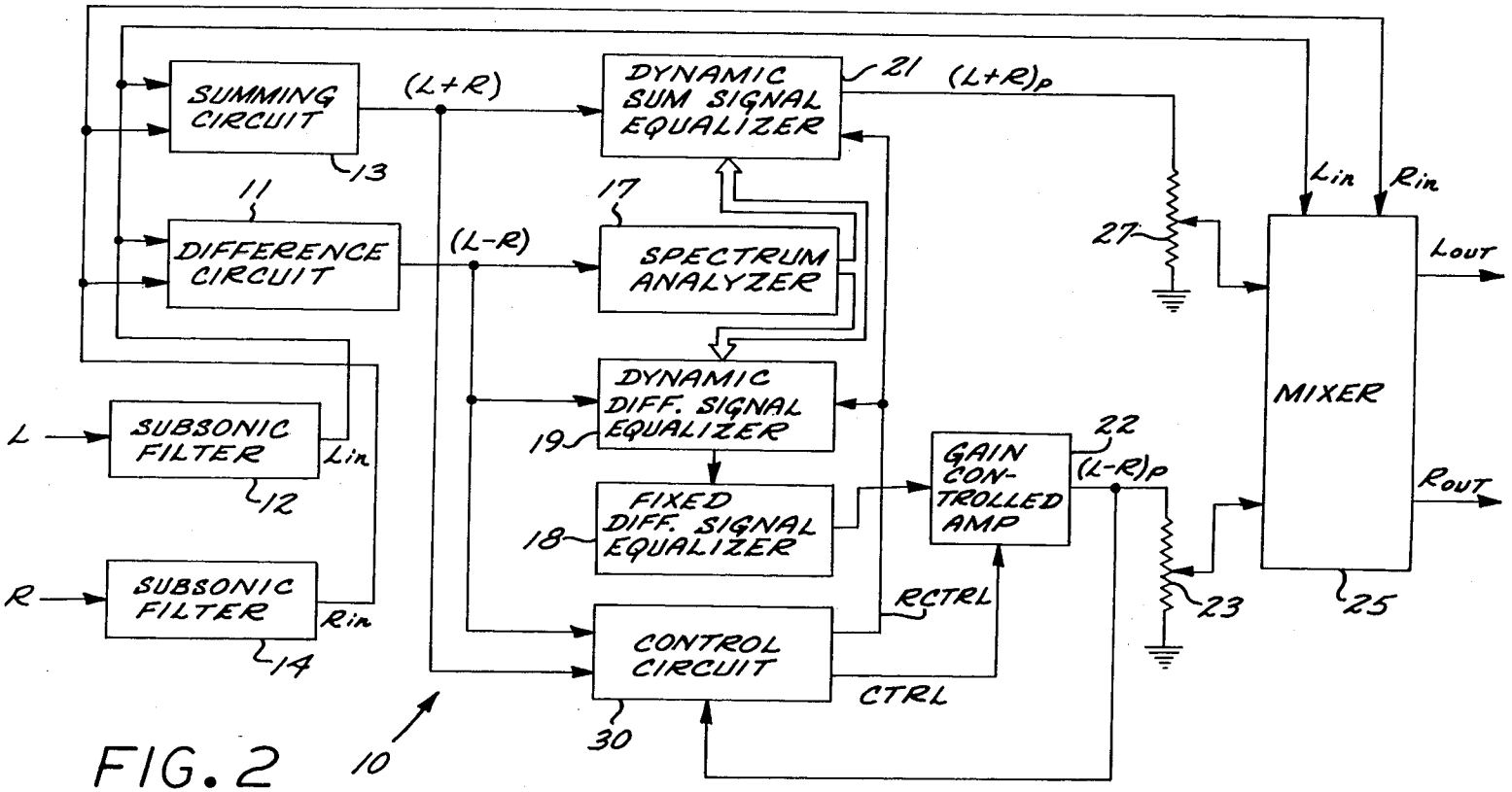
FIG. 2 is a block diagram of a dynamic stereo image enhancement system in accordance with the invention which provides for dynamic equalization.

Referring to FIG. 2, shown therein is a block diagram of a stereo image enhancement system 10 which may be utilized as the stereo image enhancement system 100 in the stereo enhancement system 300 of FIG. 1, and which provides for dynamic equalization of the sum and difference of left and right stereo signals to achieve a wider stereo image and a wider listening area. Particularly, subsonically filtered left and right stereo signals L and R at the outputs of subsonic filters 12, 14 are provided to a difference circuit 11 and a summing circuit 13 which respectively provide a difference signal (L−R) and a sum signal (L+R). A dynamic difference signal equalizer 19, a fixed difference signal equalizer 18, and a gain controlled amplifier 22 cooperate to selectively alter or modify the relative amplitudes of the difference signal frequency components (also referred to herein as "components" or "frequencies") to provide a processed difference signal $(L-R)_p$. A dynamic sum signal equalizer 21 selectively alters or modifies the relative amplitudes of the sum signal frequency components (also referred to herein as "components" or "frequencies" to provide a processed sum signal $(L+R)_p$.)

A spectrum analyzer 17, which is responsive to the difference signal provided by the difference circuit 11, controls the dynamic difference signal equalizer 19 so that the quieter components of the difference signal are boosted relative to the louder components. More specifically, the dynamic difference signal equalizer 19 is controlled to attenuate the louder difference signal components more than the quieter difference signal components. The subsequent amplification of the equalized difference signal provides for a processed difference signal wherein the quieter components have been boosted relative to the louder difference signal components.

The fixed difference signal equalizer 18 selectively attenuates the equalized difference signal provided by the dynamic difference signal equalizer 19 to provide deemphasis in a predetermined manner.

The spectrum analyzer 17 also controls the sum signal equalizer so that components of the sum signal are boosted as a direct function of the levels of corresponding difference signal components. More specifically, the sum signal equalizer 21 boosts the sum signal to provide a processed sum signal wherein the sum signal components have been boosted in proportion to the amplitudes of correspondening difference signal frequency components.

A feedback and reverberation control circuit 30 controls the gain of the gain controlled amplifier 22 so that the amount of stereo provided is relatively consistent from recording to recording. The control circuit 30 also controls the difference signal equalizer 19 and the sum signal equalizer 21 so that difference signal components that may include artificial reverberation are not inappropriately boosted when the possibility of artificial reverberation is detected. When the possibility of artificial reverberation is detected by the control circuit 30, the reverberation control signal RCTRL controls the dynamic difference signal equalizer 19 to provide further attenuation in selected frequency bands where artificial reverberation statistically occurs, and the dynamic sum signal equalizer 21 to provide further boost in such selected frequency bands. In this manner, any artificial reverberation which may be present in the difference signal is not inappropriately boosted in the subsequent amplification of the difference signal. The further boost of the sum signal ensures that the sum signal frequencies in the selected frequency bands are of sufficient level to compensate any artificial reverberation which may not have been sufficiently attenuated by the dynamic difference signal equalizer 19 pursuant to the reverberation control signal RCTRL.

The control circuit 30 is responsive to the sum and difference signals provided by the summing circuit 11 and the difference circuit 13, and also to the processed difference signal provided by the gain controlled amplifier 22.

Figure 4:
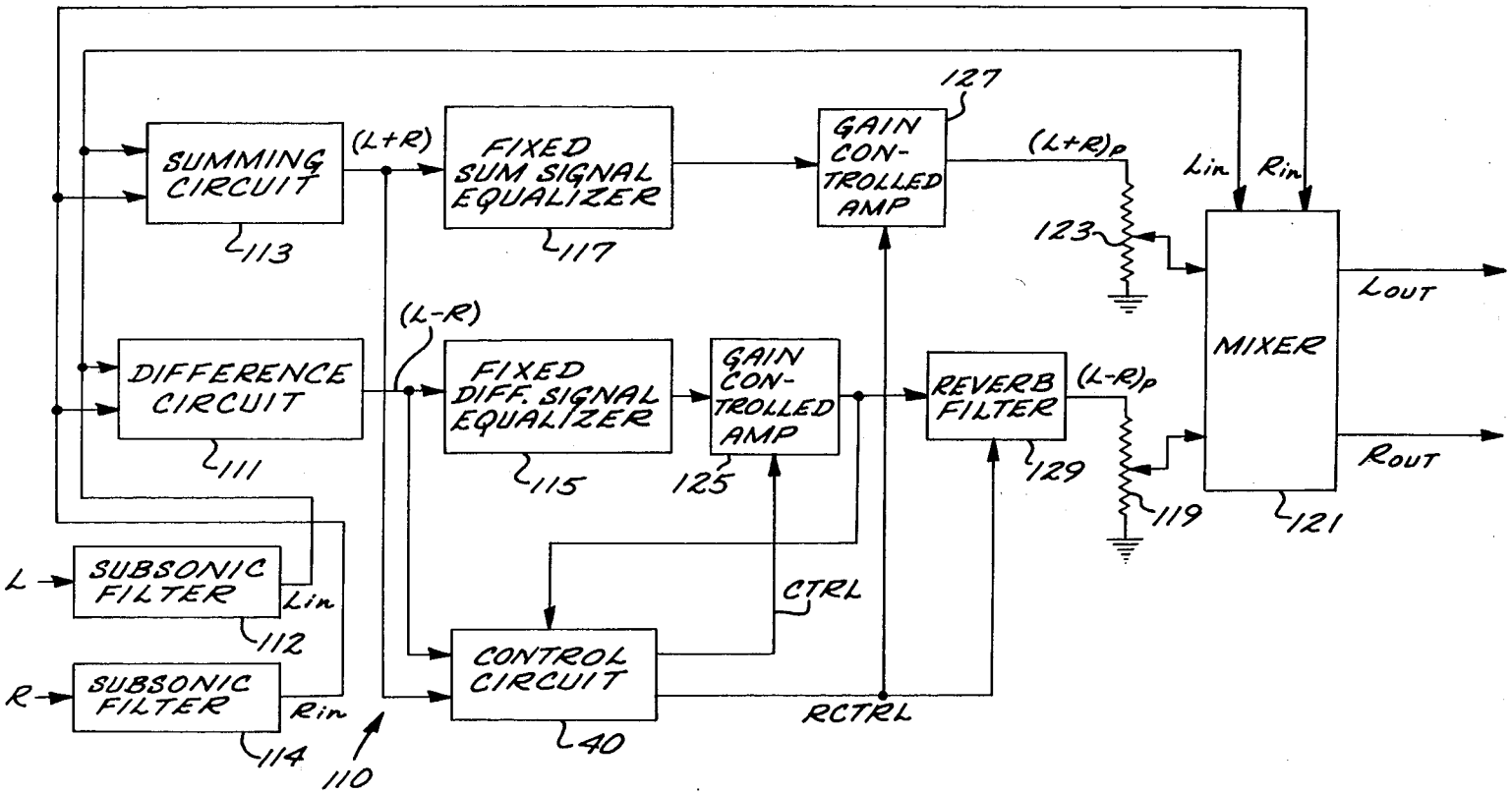
FIG. 4 is a block diagram of a non-dynamic or fixed stereo image enhancement system in accordance with the invention which provides for fixed equalization.

Referring now to FIG. 4, shown therein is a block diagram of a further embodiment of a stereo image enhancement system 110 which may be utilized as the stereo image enhancement system 100 in the stereo enhancement system of FIG. 1, and which provides for respective fixed equalization of the sum and difference of left and right stereo signals to achieve a wider stereo image and a wider listening area. Particularly, subsonically filtered left and right stereo signals L and R from subsonic filters 112, 114 are provided to a difference circuit 111 and a sum circuit 113 which generate respective difference and sum signals (L−R) and (L+R). A fixed difference signal equalizer 115, a gain controlled amplifier 125, and a reverberation filter 129 cooperate to selectively boost certain difference signal components relative to other difference signal components. A fixed sum signal equalizer 117 and a gain controlled amplifier 127 cooperate to selectively boost certain sum signal components relative to other sum signal components. Effectively, the sum and difference signals are respectively spectrally shaped or equalized in a fixed predetermined manner.

Particularly, the difference signal is equalized so that the frequencies where the quieter difference signal components statistically occur more frequently are boosted relative to the frequencies where the louder difference signal components statistically occur more frequently. The sum signal is equalized so that frequencies where the difference signal components statistically occur are boosted relative to other frequencies.

Figure 3:
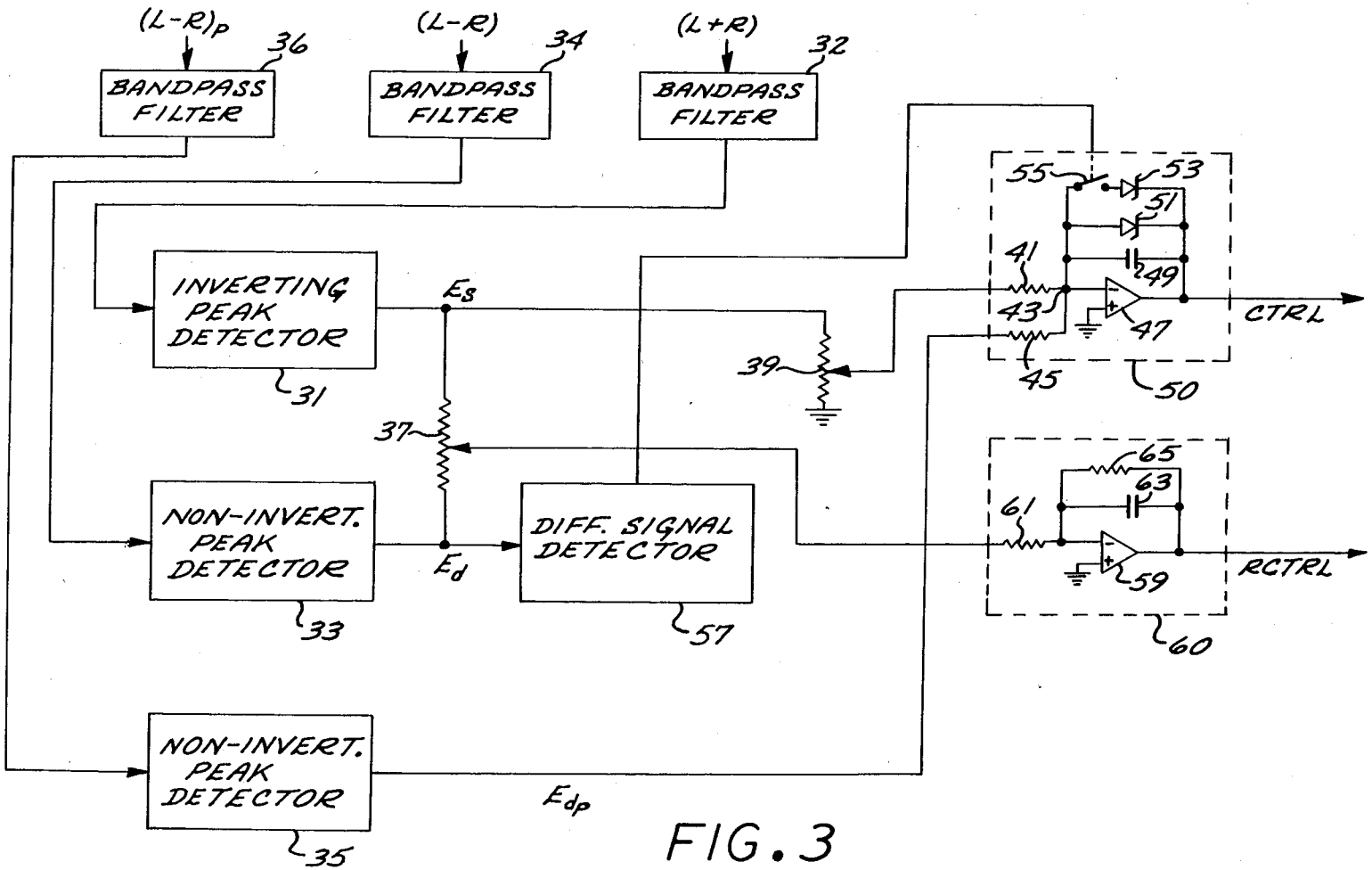
FIG. 3 is a block diagram of the feedback and reverberation control circuit for the stereo image enhancement systems of FIGS. 2 and 4.

The stereo image enhancement system 110 further includes a feedback and reverberation control circuit 40 which is substantially similar to the control circuit 30 of FIGS. 2 and 3 and provides substantially similar functions. Particularly, the control circuit 40 cooperates with the gain controlled amplifier 125 so that substantially consistent stereo is provided for differing amounts of stereo within a given recording and between different recordings.

The control circuit 40 further cooperates with the gain controlled amplifier 127 and the reverberation filter 129 to compensate the effects of artificial reverberation. When the possibility of artificial reverberation is detected, the gain controlled amplifier 127 boosts the sum signal, and the reverberation filter 129 attenuates the difference signal components that statistically include artificial reverberation relative to other difference signal components. In this manner, the difference signal components that may include artificial reverberation are not inappropriately boosted. The further boost to the sum signal is to compensate for any artificial reverberation which may not have been sufficiently attenuated by the reverberation filter 129.

Figure 6:
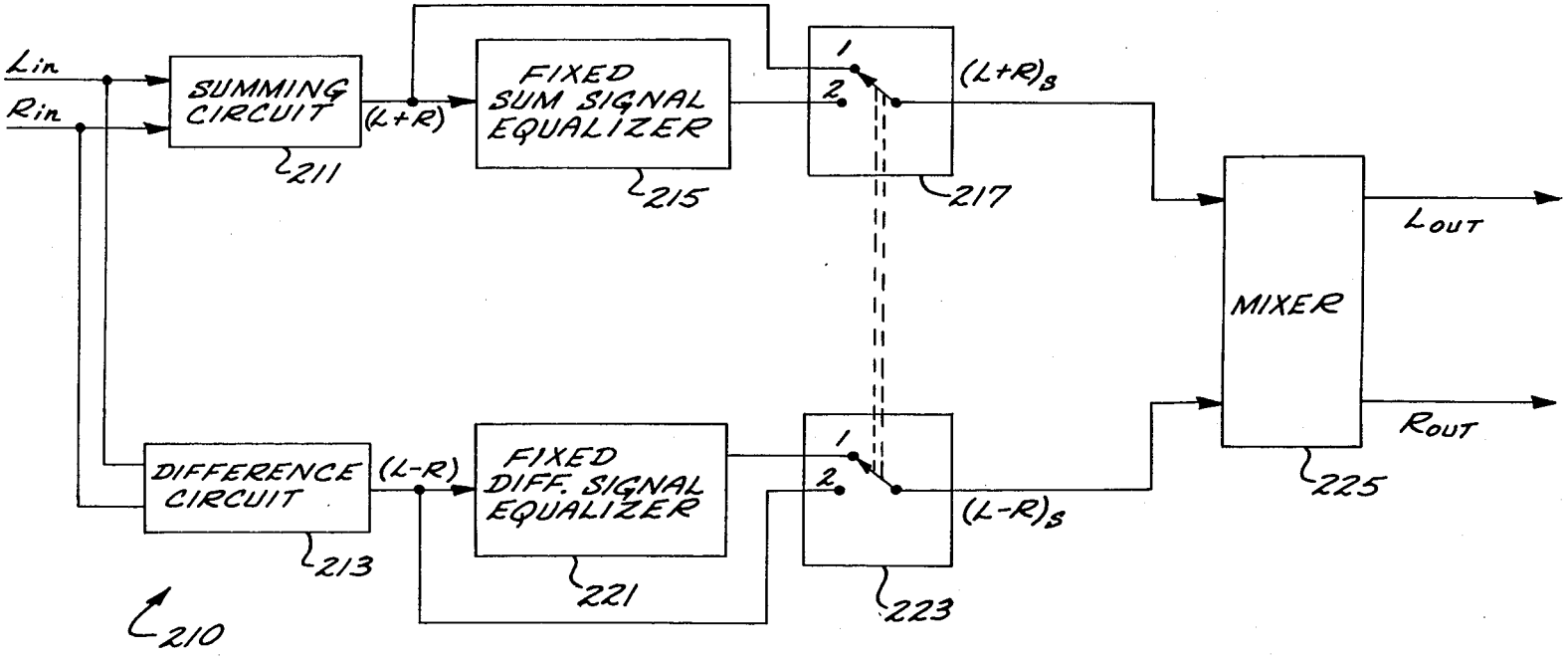
FIG. 6 is a block diagram of a sound perspective correction system in accordance with the invention.

Referring now to FIG. 6, shown therein is a block diagram of a sound perspective correction system 210 which may be utilized as the sound perspective correction system 200 in the stereo enhancement system of FIG. 1. The perspective correction system 210 is responsive to left and right signals provided by the outputs of a stereo image enhancement system in accordance with the invention as discussed above relative to FIGS. 2 and 4. Alternatively, as discussed with reference to the stereo enhancement system 300 of FIG. 1, the left and right signals may be provided by an appropriate audio preamplifier.

The sound perspective correction system 210 includes a summing circuit 211 and a difference circuit 213 for respectively providing sum and difference signals (L+R) and (L−R). The sum and difference signals are respectively equalized by a fixed sum signal equalizer 215 and a fixed difference signal equalizer 221, which provide different equalization characteristics.

Particularly, the fixed sum signal equalizer 215 provides for one equalization output, and the fixed difference signal equalizer 221 provides for one equalization output. A pair of two position switches 217, 223 control whether equalized or non-equalized sum and difference signals are provided to a mixer 225. The selection of the signals provided to the mixer 225 is determined by the type of sound transducers (e.g., speakers or headphones) and/or the location of the sound transducers (e.g., front or side) used for sound reproduction. The mixer 225 mixes the sum and difference signals to provide processed left and right output signals which are the outputs of the sound perspective correction system 210. As discussed above relative to the stereo enhancement system 300 of FIG. 1, the outputs of the sound perspective system 210 may be provided to the preamplifier tape monitor loop input or to a standard power amplifier.

II.

DETAILED BLOCK DIAGRAM DISCUSSION

A. The Dynamic Stereo Image Enhancement System

Referring again to FIG. 2, the stereo image enhancement system 10 of the invention includes a left input signal subsonic filter 12 and a right input signal subsonic filter 14 which are responsive to left and right stereo signals L and R provided by a stereo sound reproduction system (not shown). For example, the left and right stereo signals L and R may be provided by a preamplifier tape monitor loop output. The subsonic filters 12, 14 provide subsonically filtered input signals $L_{in}$ and $R_{in}$ to a difference circuit 11 and a summing circuit 13.

Each of the subsonic filters 12, 14 is a high pass filter having a −3 dB frequency of 30 Hz and a roll-off of 24 dB per octave. The sharp roll-off provides some protection against damage to speakers in the event a phono cartridge is accidentally dropped. Vertical displacement of a stylus due to dropping a phono cartridge is manifested as low frequency difference signal components with large amplitudes, which could be potentially damaging to speakers. The sharp subsonic filter roll-off cuts off such low frequency components to reduce the possibility of damage.

The difference circuit 11 subtracts the right subsonically filtered signal $R_{in}$ from the left subsonically filtered signal $L_{in}$ to provide a difference signal (L−R), while the summing circuit 13 adds the left and right subsonically filtered input signals $L_{in}$ and $R_{in}$ to provide a sum signal (L+R).

The difference signal (L−R) is provided to a multi-band spectrum analyzer 17. The difference signal (L−R) is further provided to a multi-band dynamic difference signal equalizer 19 which is controlled by control signals provided by the spectrum analyzer 17. The sum signal (L+R) is provided to a multi-band dynamic sum signal equalizer 21 which is also controlled by the control signals provided by the spectrum analyzer 17.

The multi-band spectrum analyzer 17 is responsive to predetermined frequency bands and provides respective control signals associated with each of the predetermined frequency bands. Particularly, such control signals are proportional to respective average amplitudes of the difference signal (L−R) within the respective predetermined frequency bands. By way of example, the multi-band spectrum analyzer 17 includes a plurality of one octave wide bandpass filters respectively centered in the predetermined frequency bands and respectively having roll-offs of 6 dB per octave. The respective outputs of the bandpass filters are rectified and appropriately buffered to provide the control signals.

The dynamic difference signal equalizer 19 is also responsive to the predetermined frequency bands and selectively cuts (attenuates) the difference signal frequencies in such predetermined frequency bands in response to the control signals provided by the spectrum analyzer 17. Specifically, the difference signal equalizer 19 attenuates the difference signal components within the respective predetermined frequency bands as a direct function of the respective control signals provided by the spectrum analyzer 17. That is, for a given frequency band, attenuation increases as the average amplitude of the difference signal (L−R) within such frequency band increases.

Figure 5A:
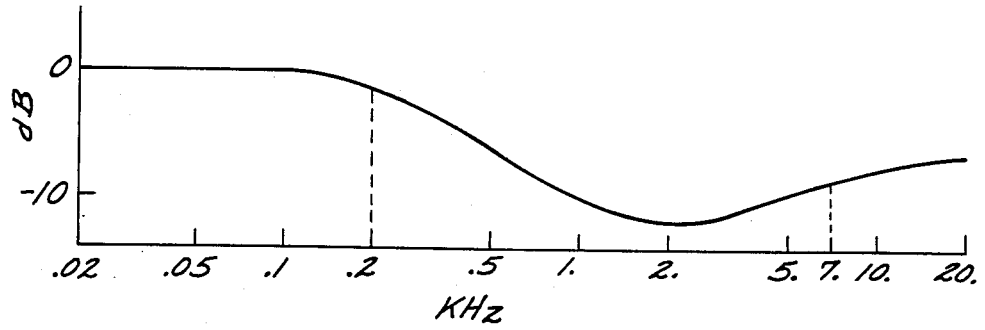
FIGS. 5A and 5B are plots of the equalization provided by the fixed stereo image enhancement system of FIG. 4.

The output of the dynamic difference signal equalizer 19 is provided to a fixed difference signal equalizer 18 which attenuates selected frequencies of the dynamically equalized difference signal in a predetermined manner. An appropriate equalization characteristic for the fixed difference signal equalizer 18 is shown in FIG. 5A. By way of example, the fixed difference signal equalizer 18 may include a plurality of parallel filter stages including a low pass filter and a high pass filter having the following characteristics. The low pass filter has a −3 dB frequency of about 200 Hz, a roll-off of 6 dB per octave, and a gain of unity. The high pass filter has a −3 dB frequency of about 7 KHz, a roll-off of 6 dB per octave, and a gain of one-half.

The fixed equalization of the fixed difference equalizer 18 is provided (a) so that frequencies to which the ear has greater sensitivity (about 1 KHz to about 4 KHz) are not inappropriately boosted, and (b) so that difference signal components having wavelengths comparable to the distance between the ears of a listener (the previously discussed "difference signal components of increased phase sensitivity") are not inappropriately boosted. Alternatively, such fixed equalization may be provided prior to dynamic equalization.

The difference signal provided by the fixed difference signal equalizer 18 is amplified by a gain controlled amplifier 22 to provide a processed difference signal $(L-R)_p$.

The dynamic sum signal equalizer 21 is also responsive to the predetermined frequency bands and selectively boosts the sum signal frequencies in such predetermined frequency bands in response to the control signals provided by the spectrum analyzer 17. Specifically, the dynamic sum signal equalizer 21 boosts the sum signal components within the respective predetermined frequency bands as a direct function of the respective control signals provided by the spectrum analyzer 17. That is, for a given frequency band, boost increases as the average amplitude of the difference signal (L−R) within such frequency band increases. The output of the dynamic sum signal equalizer 21 is a processed sum signal $(L+R)_p$.

The predetermined frequency bands for the spectrum analyzer 17, the dynamic difference equalizer 19, and the dynamic sum signal equalizer 21 include seven (7) bands of one octave width each which are respectively centered at 125 Hz, 250 Hz, 500 Hz, 1 KHz, 2 KHz, 4 KHz, and 8 KHz. A larger or smaller number of predetermined frequency bands may be readily utilized.

The dynamic difference signal equalizer 19 provides for each of the frequency bands a maximum attenuation of 12 dB for the maximum level of the corresponding control signals provided by the spectrum analyzer 17. No attenuation would be provided for a control signal having a zero level. Similarly, the dynamic sum signal equalizer 21 provides for each of the frequency bands a maximum boost of 6 dB for the maximum level of the corresponding control signals provided by the spectrum analyzer 17. No boost would be provided for a control signal having a zero level.

The control signals provided by the spectrum analyzer 17 have a range between 0 volts and 8 volts. The corresponding range of attenuation provided by the dynamic difference signal equalizer 19 would be between 0 dB and −12 dB, while the corresponding range of boost provided by the sum signal equalizer 21 would be between 0 dB and 6 dB.

It should be readily apparent that for a given control signal for a particular frequency band, the value of the boost provided by the dynamic sum signal equalizer 21 is one-half of the value of the attenuation provided by the dynamic difference signal equalizer 19. Other ratios may be utilized, but it is important that the level of boost provided by the dynamic sum signal equalizer 21 be less than the corresponding level of attenuation provided by the dynamic difference signal equalizer 19. Such reduced boost has been found to be appropriate since most recordings include more sum signal than difference signal. A maximum boost level approaching the maximum attenuation level would result in inappropriately high levels of the processed sum signal $(L+R)_p$.

As discussed further herein, selected frequency bands of the dynamic difference signal equalizer 19 and the dynamic sum signal equalizer 21 are further responsive to other control signals. The foregoing discussion of the responses of such equalizers to the control signals provided by the spectrum analyzer were based on such other control signals having zero levels. To the extent that other control signals have non-zero levels, the total attenuation or boost is the superposition of the individual attenuation or boost due to the individual control signals. In other words, the respective control signals are added.

It should be noted that preferably the dynamic difference signal equalizer 19 is configured to provide for each of the frequency bands a maximum attenuation, such as 12 dB, in order to avoid inappropriate levels of attenuation. Similarly, the dyanamic sum signal equalizer 21 is preferably configured to provide for each of the frequency bands a maximum boost, such as 6 dB, in order to avoid inappropriately high levels of boost.

The stereo image enhancement system 10 further includes a feedback and reverberation control circuit 30 which cooperates with other elements in the system to provide for automatic adjustment of the stereo image enhancement provided and for reverberation compensation. The characteristics of recordings that make automatic enhancement adjustment and reverberation compensation desirable are discussed further below.

The control circuit 30 (described in more detail below relative to FIG. 3) is responsive to the difference signal (L−R) provided by the difference circuit 11 and the sum signal (L+R) provided by the sum circuit 13. The control circuit 30 provides a gain control signal CTRL or controlling the gain controlled amplifier 22 which varies the gain applied to the difference signal provided by the fixed difference signal equalizer 18. The control circuit 30 is further responsive to the processed difference signal $(L-R)_p$ provided by the gain controlled amplifier 22, thereby providing a closed loop system for controlling the processed difference signal $(L-R)_p$.

The control circuit 30 controls the gain of the gain controlled amplifier 22 to maintain a constant ratio between (1) the sum signal (L+R) provided by the summing circuit 13 and (2) the processed difference signal $(L-R)_p$ output of the gain controlled amplifier 22. By way of example, the gain controlled amplifier 22 may be an appropriate voltage controlled amplifier.

The control circuit 30 further provides a reverberation control signal RCTRL to the difference signal equalizer 19 and the sum signal equalizer 21 for controlling the amount of equalization provided in the frequency bands centered at 500 Hz, 1 KHz, and 2 KHz (herein the "reverberation bands"). The presence of artificial reverberation, which is almost always in difference signal frequencies in the reverberation bands, is indicated by a larger than expected ratio between the sum signal and the difference signal, since a large ratio indicates the presence of a center stage soloist (vocalist or instrumentalist), which in turn indicates the possibility of artificial reverberation. The control circuit 30, therefore, monitors the ratio between the sum signal (L+R) and the difference signal (L−R). When the possible presence of artificial reverberation is detected (for example, when the sum signal to difference signal ratio is greater than a predetermined value), the reverberation control signal RCTRL provides further control of the reverberation bands in the difference signal equalizer 19 and the sum signal equalizer 21.

As to the difference signal equalizer 19, the reverberation control signal RCTRL causes further attenuation in the above specified reverberation bands in addition to the attenuation resulting from the control signals provided by the spectrum analyzer 17. As to the sum signal equalizer 21, the reverberation control signal RCTRL causes further boost in the above specified reverberation bands in addition to the boost resulting from the control signals provided by the spectrum analyzer 17.

The further attenuation of the difference signal components within the reverberation bands is to prevent any artificial reverberation which may be accompanying a soloist from being inappropriately boosted when the processed difference signal is subsequently amplified. The further boost of the sum signal components within the reverberation bands insures that the sum signal components in the reverberation bands are of sufficient level to compensate any artificial reverberation that is not sufficiently attenuated by the dynamic difference signal equalizer 19.

The dynamic difference signal equalizer 19 provides for each of the above specified reverberation bands a maximum attenuation of 12 dB for the maximum level of the reverberation control signal RCTRL, with no corresponding control signal from the spectrum analyzer 17 present. The total attenuation provided in response to both the reverberation control signal RCTRL and a corresponding control signal from the spectrum analyzer 17 would be the superposition of the respective attenuations in response to the individual control signals. However, as noted previously, the dynamic difference signal equalizer 19 is preferably configured to provide a predetermined maximum attenuation, such as 12 dB, regardless of the levels of the control signals.

The dynamic sum signal equalizer 21 provides for each of the above specified reverberation bands a maximum boost of 6 dB for the maximum level of the reverberation control signal RCTRL, with no corresponding control signal from the spectrum analyzer 17 present. The total boost provided in response to both the reverberation control signal RCTRL and a corresponding control signal from the spectrum analyzer 17 would be the superposition of the respective boosts in response to the individual control signals. However, as noted previously, the dynamic sum signal equalizer 21 is preferably configured to provide a predetermined maximum boost, such as 6 dB, regardless of the levels of the control signals.

Alternatively, reverberation compensation for the processed sum signal may be achieved by utilizing a gain controlled amplifier (not shown) to vary the gain applied to the equalized sum signal provided by the dynamic sum signal equalizer 21. Such gain controlled amplifier would amplify the processed sum signal as a function of the reverberation control signal RCTRL. If a gain controlled amplifier to amplify the processed sum signal is utilized to compensate the effects of artificial reverberation, the reverberation control signal RCTRL would not be provided to the dynamic sum signal equalizer 21.

The output of the gain controlled amplifier 22 is coupled to one fixed terminal of a potentiometer 23 which has its other fixed terminal coupled to ground. The wiper contact of the potentiometer 23 is coupled to a mixer 25 which therefore receives the processed difference signal $(L-R)_p$ having a level controlled by the gain controlled amplifier 22 and the potentiometer 23.

As mentioned previously, the control circuit 30 and the gain controlled amplifier 22 control the ratio between the sum signal (L+R) provided by the summing circuit 13 and the processed difference signal $(L-R)_p$ provided by the gain controlled amplifier 22. As discussed further herein, that ratio is controlled by circuitry within the control circuit 30. The potentiometer 23 provides further control over the amount of stereo enhancement provided.

The output of the dynamic sum signal equalizer 21 is coupled to one fixed terminal of a potentiometer 27 which has its other fixed terminal coupled to ground. The wiper contact of the potentiometer 27 is coupled to the mixer 25 which therefore receives the processed sum signal $(L+R)_p$ having a level controlled by the potentiometer 27. The potentiometer 27 controls the level of the sound image at center stage.

The left and right subsonically filtered input signals $L_{in}$ and $R_{in}$ are provided as further inputs to the mixer 25. The mixer 25 combines the processed sum signal $(L+R)_p$ and the processed difference signal $(L-R)_p$ with the left and right input signals $L_{in}$ and $R_{in}$ to provide left and right output signals $L_{out}$ and $R_{out}$. Particularly, the left and right output signal $L_{out}$ and $R_{out}$ are provided by the mixer 25 in accordance with the following:

$$L_{out}=L_{in}+K_1(L+R)_p+K_2(L-R)_p \quad \text{(Equation 1)}$$

$$R_{out}=R_{in}+K_1(L+R)_p-K_2(L-R)_p \quad \text{(Equation 2)}$$

The value of $K_1$ is controlled by the potentiometer 27; and the value of $K_2$ is controlled by the potentiometer 23.

The overall effect of processing the difference signal (L−R) is that the quieter difference signal components are boosted relative to the louder difference signal components. That is, the selective attenuation of the difference signal followed by amplification provides a processed difference signal wherein the louder components may be comparable in level to their original levels while the quieter difference signal components have levels greater than their original levels.

The processing of the sum signal (L+R) is to raise the level of the sum signal so that it is not overwhelmed by the selective boosting of difference signal components.

The potentiometers 23, 27 are user controlled elements to allow the user to control the respective levels of the processed sum signal $(L+R)_p$ and the processed difference signal $(L-R)_p$ that are mixed by the mixer 25. For example, the potentiometers 23, 27 may be adjusted to minimize the processed difference signal and to maximize the processed sum signal. With such adjustment, the listener would hear primarily any center stage soloist present in the recording being played.

The left and right output signals $L_{out}$ and $R_{out}$ are provided to the sound perspective correction system 200 of the stereo enhancement system 300 of FIG. 1. Alternatively, as discussed relative to the stereo enhancement system 300 of FIG. 1 and to the extent that the sound perspective correction system 200 is not utilized, the left and right output signals $L_{out}$ and $R_{out}$ are appropriately provided, for example, to the tape monitor loop input of the preamplifier tape monitor loop that provided the left and right stereo signals L and R.

B. The Feedback and Reverberation Control Circuit

Referring now to FIG. 3, shown therein is a block diagram of the feedback and reverberation control circuit 30 which includes a bandpass filter 32 that is responsive to the sum signal (L+R) and provides its output to an inverting peak detector 31. The output of the inverting peak detector 31 is an inverted sum signal envelope $E_s$. Preferably, the bandpass filter 32 has a −3 dB bandwidth of 4.8 KHz located between 200 Hz and 5 KHz and a roll-off of 6 dB per octave. The bandpass filter 32 filters out the effects of clicks and pops that may be present in recordings, and further filters out high energy low frequency components which would have an undesirable effect on the control signals provided by the control circuit 30. The time constants of the peak detector circuit 31 provide a rise time in the order of one millisecond and a decay time in the order of one-half second.

The feedback and reverberation control circuit 30 further includes a bandpass filter 34 that is responsive to the difference signal (L−R) and provides its output to a non-inverting peak detector 33. The output of the non-inverting peak detector 33 is a non-inverted difference signal envelope $E_d$. The bandpass filter 34 has characteristics similar to those of the bandpass filter 32 and has a −3 dB bandwidth of 4.8 KHz located between 200 Hz and 5 KHz, and a roll-off of 6 dB per octave. The time constants of the peak detector circuit 33 provide a rise time in the order of one millisecond and a decay time in the order of one-half second.

The feedback and reverberation control circuit 30 includes another bandpass filter 36 that is responsive to the processed difference signal $(L-R)_p$ and provides its output to a non-inverting peak detector 35. The output of the non-inverting peak detector 35 is non-inverted processed difference signal envelope $E_{dp}$. The bandpass filter 36 has characteristics similar to those of the bandpass filters 32, 34, and has a −3 dB passband of 4.8 KHz located between 200 Hz and 5 KHz and a roll-off of 6 dB per octave. The time constants of the peak detector 35 provide a rise time in the order of one millisecond and a decay time in the order of one-half second.

The outputs of the inverting peak detector 31 and the non-inverting peak detector 33 are respectively coupled to the fixed contacts of a potentiometer 37. As discussed more fully further herein, the signal available at the wiper contact of the potentiometer 37 is coupled to an averaging circuit 60 which provides the reverberation control signal RCTRL.

The output of the inverting peak detector 31 is further coupled to one fixed terminal of a potentiometer 39 which has its other fixed terminal coupled to ground. The inverted sum signal envelope $E_s$ provided at the wiper contact of the potentiometer 39 is coupled via a summing resistor 41 to the summing junction 43 of an integrator 50. The non-inverted processed difference signal envelope $E_{dp}$ provided by the non-inverting peak detector 35 is also coupled to the summing junction 43 via a summing resistor 45.

The integrator 50 further includes an operational amplifier 47 which has its inverting input connected to the summing junction 43 and has its non-inverting input connected to ground. An integrating capacitor 49 is connected between the output of the operational amplifier 47 and the summing junction 43. A zener clamp diode 51 is coupled between the output of the operational amplifier and the summing junction 43, and the functions to limit the maximum level of the control signal CTRL provided by the operational amplifier 47.

Further, the integrator 50 includes a zener diode 53 and a switch 55 serially coupled between the output of the operational amplifier 47 and the summing junction 43. The zener diode 53 has a value that is about in the middle of the output swing of the operational amplifier 47 as controlled by the zener clamp diode 51. The switch 55 is controlled by a difference signal detector 57 which is responsive to the difference signal envelope $E_d$ provided by the peak detector 33. Specifically, the difference signal detector 57 controls the switch 55 to close and clamp the level of the integrator output CTRL when little or no difference signal envelope $E_d$ is present. By way of example, the difference signal detector 57 may be a voltage comparator (or an operational amplifier biased as a voltage comparator) with an appropriate threshold reference near zero.

The switched clamp circuit including the zener diode 53 and the switch 55 prevent a substantial increase in the gain provided by the gain controlled amplifier 22 when the left and right input signals $L_{in}$ and $R_{in}$ contain very little or no stereo information. Without such a switched clamp circuit, left and right input signals containing very little or no stereo information would cause the integrator output CTRL to go to its maximum level since very little or no processed difference signal would be present. Such maximum level of the control signal CTRL would cause the gain controlled amplifier 22 to provide maximum gain, and when the input signals $L_{in}$ and $R_{in}$ subsequently contain stereo information, the processed difference signal would be dramatically amplified to the detriment of the audio equipment and listeners' comfort.

An alternative arrangement (not shown) of the switched clamp circuit 50 completely eliminates that one feedback path of amplifier 47 which includes zener diode 53 and switch 55. In such alternative arrangement, the switch 55 is connected between the summing junction 43 and the connection of the feedback path of capacitor 49, diode 51 to the inverting input to amplifier 47. The switch is still operated from the output of difference signal detector 57, which in this case, is connected to cause the switch to open when the difference signal detector 57 detects loss of the difference signal. Thus, with the loss of difference signal in such an alternative arrangement, the charge on integrating capacitor 49 remains frozen and, because the capacitor remains connected to the amplifier at all times, remains at the level existing upon the opening of the switch. Therefore the control signal from the output of amplifier 47 will not increase upon loss of the difference signal.

The output of the integrator 50 is the gain control signal CTRL and is indicative of the sum of (a) the inverted sum signal envelope $E_s$ provided to the summing junction 43 and (b) the non-inverted processed difference signal envelope $E_{dp}$ provided to the summing junction 43. The gain control signal CTRL is utilized to vary the gain applied to the processed difference signal $(L-R)_p$ by the gain controlled amplifier 22 (FIG. 1) so that the sum of the sum and processed difference signal envelopes $E_s$, $E_{dp}$ applied to the summing resistors 41, 45 of the integrator 50 tends toward zero. Thus, the non-inverted processed difference signal envelope $E_{dp}$ provided to the summing junction 43 tends to inversely track or follow the inverted sum signal envelope $E_s$ provided to the summing junction 43.

Referring to FIG. 2, the control circuit 30 and the gain controlled amplifier 22 in essence cooperate to maintain a predetermined ratio between the sum signal (L+R) provided by the summing circuit 13 and the processed difference signal $(L-R)_p$ provided by the gain controlled amplifier 22. That predetermined ratio is set by the potentiometer 39 (FIG. 3).

As mentioned earlier, the averaging circuit 60 is responsive to the signal at the wiper contact of the potentiometer 37. The signal at the wiper contact of the potentiometer 37 is the sum of the inverted sum signal envelope $E_s$ and the non-inverted difference signal envelope $E_d$, where the amount contributed by each envelope to the sum of envelopes is determined by the position of the wiper contact. Since the sum signal envelope is inverted and the difference signal is non-inverted, the sum of envelopes will tend to go to zero if the sum and difference envelopes at the wiper contact are close to being equal and opposite.

The averaging circuit 60 includes an operational amplifier 59 and an input resistor 61 coupled between the inverting input of the operational amplifier 59 and the wiper contact of the potentiometer 37. The non-inverting input of the operational amplifier 59 is connected to ground, and the output of the operational amplifier is the reverberation control signal RCTRL. A capacitor 63 and a resistor 65 are coupled in parallel between the output of the operational amplifier 59 and its inverting input. Effectively, the averaging circuit 60 is an integrator with a resistor coupled across the integrating capacitor.

So long as the sum of envelopes signal at the wiper contact of the potentiometer 37 is near zero, the reverberation control signal provided by the averaging circuit 60 is near zero. When the contribution of the sum signal envelope to the sum of envelopes signal at the wiper contact becomes predominant, the level of the reverberation control signal RCTRL increases. The predominance of the contribution of the sum signal, as determined by the setting of the potentiometer 37, indicates the possible presence of a center stage soloist, which in turn indicates the possibility of artificial reverberation in the difference signal.

In essence, the potentiometer 37 and the averaging circuit 60 cooperate to provide the reverberation control signal RCTRL when the ratio between (a) the inverted sum signal envelope $E_s$ and (b) the non-inverted difference signal envelope $E_d$ exceeds a predetermined value. That predetermined value is determined by the setting of the potentiometer 37. The reverberation control signal RCTRL is indicative of the amount by which that predetermined ratio is exceeded.

Figure 10:
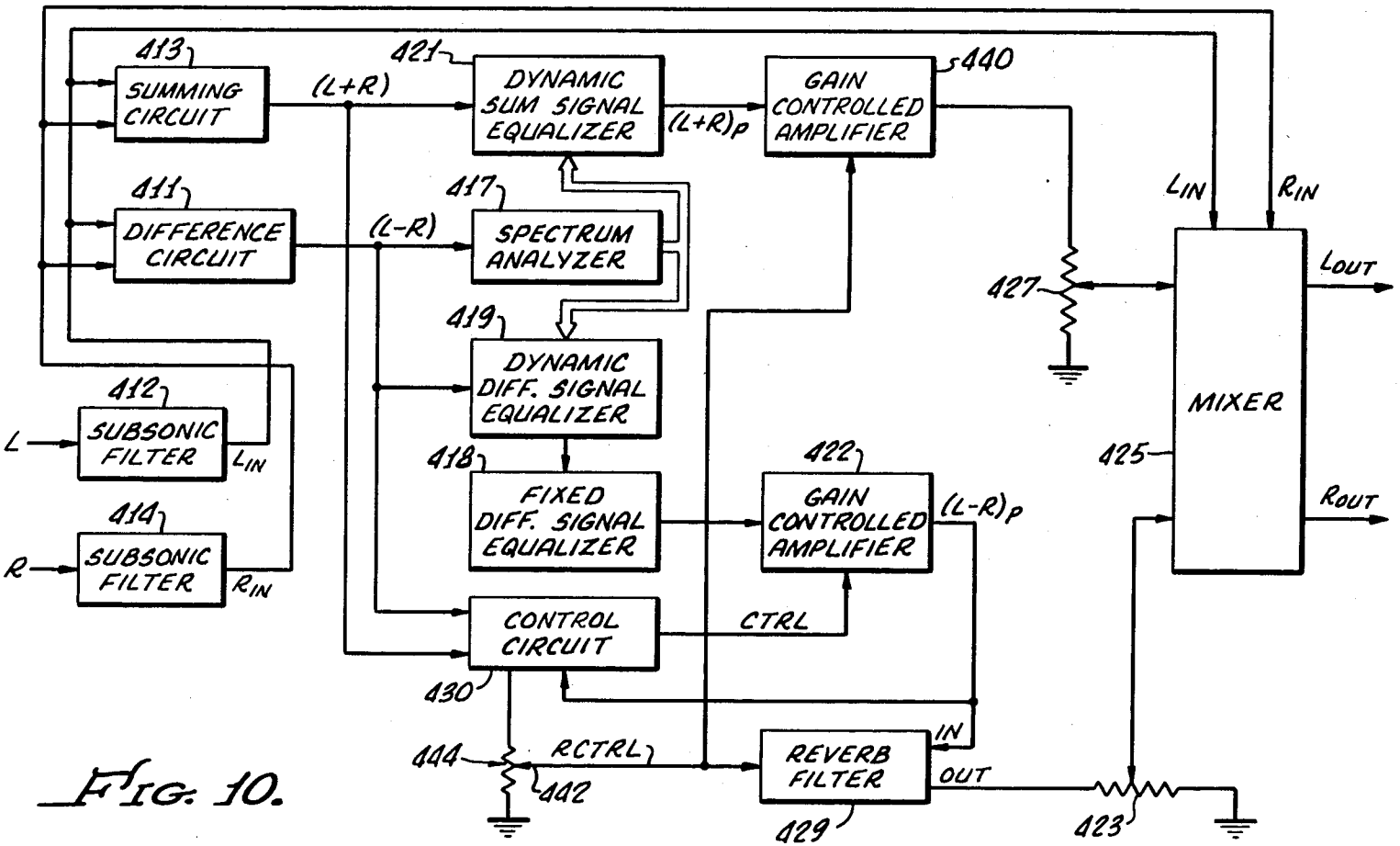
FIG. 10 is a block diagram of the stereo enhancement system having automatic and manual control of reverberation enhancement.

The reverberation control signal RCTRL provided at the output of the averaging circuit 60 is utilized to provide further controls to the reverberation bands (referenced previously in regard to FIG. 2 and centered at 500 Hz, 1 KHz, and 2 KHz) of the dynamic difference signal equalizer 19 and the dynamic sum signal equalizer 21. Specifically, the reverberation control signal RCTRL causes the dynamic difference signal equalizer 19 to provide further attenuation in the reverberation bands and causes the dynamic sum signal equalizer 21 to provide further boost in the reverberation bands. As mentioned previously, reverberation compensation of the processed sum signal may alternatively be achieved by selectively amplifying the output of the dynamic sum signal equalizer 21 with a gain controlled amplifier (not shown) pursuant to control by the reverberation control signal RCTRL. Such an arrangement is illustrated in FIG. 10 and described in detail below.

Since artificial reverberation is generally manifested in the difference signal components in the above-referenced reverberation bands, the further attenuation causes by the reverberation control signal RCTRL reduces the boost provided to any artificial reverberation that may be present. The further boost to the sum signal components in the reverberation bands is to compensate for any artificial reverberation which may not have been sufficiently attenuated by the dynamic difference signal equalizer 19.

Preferably, the potentiometer 37 is adjusted so that the sum of envelopes signal at the wiper contact is at a null or slightly biased toward the difference signal for input stereo signals that do not include a soloist.

It should be noted that the input to the averaging circuit 60 may alternatively be provided by other bandpass filter and peak detector circuitry, where each of such bandpass filters has a bandwidth which is more suitable to the detection of the possibility of the presence of reverberation.

In the foregoing stereo image enhancement system 10, automatic enhancement adjustment and reverberation compensation have been provided for the following reasons.

It has been determined that the amount of stereo information present in recordings varies considerably from recording to recording. For example, one recording may be close to being monaural while another may have "ping-pong" stereo where a sound source appears to move from side-to-side. As a result of the recording to recording variation in setero information, and also such variation within a single recording, continual adjustment of the amount of enhancement may be required, and such adjustment is automatically and continually provided by the control circuit 30 and the gain controlled amplifier 22.

It has also been determined that recordings may include artificial acoustical or electronic reverberation, for example, for soloists featured at center stage. Such artificial reverberation is generally manifested in the difference signal (L−R). Analysis of a variety of recordings revealed that the primary energy of artificial reverberation is in the range between 250 Hz and 2500 Hz, particularly as to male and female vocalists. Such artificial reverberation may be a function of one or more of the vocal formants, possibly the first and/or second. See "The Acoustics of the Singing Voice," J. Sundberg, 1977, *The Physics of Music,* Scientific American, W. H. Freeman & Company.

When the processed difference signal $(L-R)_p$ is increased for greater stereo enhancement, any artificial reverberation that may be present is also increased and may under some circumstances overwhelm the processed sum signal $(L+R)_p$. The presence of artificial reverberation is compensated by the control circuit 30 in cooperation with the selected reverberation bands of the difference signal equalizer 19 and the sum signal equalizer 21.

In the foregoing stereo image enhancement system 10, the sum signal equalizer 21 and the difference signal equalizer 19 are dynamically controlled by the spectrum analyzer 17, and in that sense the system is referred to as the dynamic stereo image enhancement system 10. Alternatively, a simplified non-dynamic equalization or fixed equalization stereo image enhancement system may be provided which does not include the spectrum analyzer 17 and which provides for fixed equalization of the sum and difference signals.

C. The Fixed Stereo Image Enhancement System

Referring particularly to FIG. 4, shown therein is a block diagram of a statistical or fixed stereo image enhancement system 110 which includes a left input signal subsonic filter 112 and a right input signal subsonic filter 114 which are responsive to left and right stereo signals L and R provided by a stereo sound reproduction system (not shown). For example, as discussed above relative to the stereo enhancement system 300 of FIG. 1, the left and right stereo signals L and R may be provided for a preamplifier tape monitor loop output. The subsonic filters 112, 114 provide subsonically filtered input signals $L_{in}$ and $R_{in}$ to a summing circuit 111 and a difference circuit 113.

As discussed above relative to the dynamic stereo image enhancement system of FIG. 2, the subsonic filters 112, 114 afford protection against damage due to dropping to phono cartridge.

The difference circuit 111 subtracts the right signal $R_{in}$ from the left signal $L_{in}$ to provide a difference signal (L−R), and the summing circuit 113 adds the subsonically filtered left and right input signals $L_{in}$ and $R_{in}$ to provide a sum signal (L+R).

The difference signal (L−R) provided by the difference circuit 111 is provided to a fixed difference signal equalizer 115 which selectively attenuates the difference signal as a function of frequency. The fixed difference signal equalizer 115 is substantially similar to the fixed difference signal equalizer 18 of the dynamic stereo image enhancement system 10 of FIG. 2, and an appropriate equalization characteristic is shown in FIG. 5A. By way of example, the fixed difference signal equalizer 115 may include a plurality of parallel filter stages including a low pass filter and a high pass filter having the following characteristics. The low pass filter has a −3 dB frequency of about 200 Hz, a roll-off of 6 dB per octave, and a gain of unity. The high pass filter has a −3 dB frequency of about 7 KHz, a roll-off of 6 dB per octave, and a gain of one-half.

As discussed further herein, further amplification for the equalized difference signal output of the fixed difference equalizer 115 is provided by a gain controlled amplifier 125. Such amplification may also be provided, at least in part, by the fixed difference signal equalizer 115. The output of the gain controlled amplifier 125 is coupled to a reverberation filter 129 which provides a processed difference signal $(L-R)_p$ as its output.

Referring to FIG. 5A, it should be noted that the difference signal is particularly attenuated in the range of about 1 KHz to about 4 KHz since the human ear has greater sensitivity to such frequencies and since such frequency range includes difference signal components having wavelengths that are comparable to the distance between a listener's ears (the "frequencies of increased phase sensitivity"). As discussed previously and relative to the prior art, loud difference signals within such frequencies result in annoying harshness and limit a listener to being located equidistant between the speakers. By attenuating such frequencies, the harshness and the limitation on location are substantially reduced.

Figure 5B:
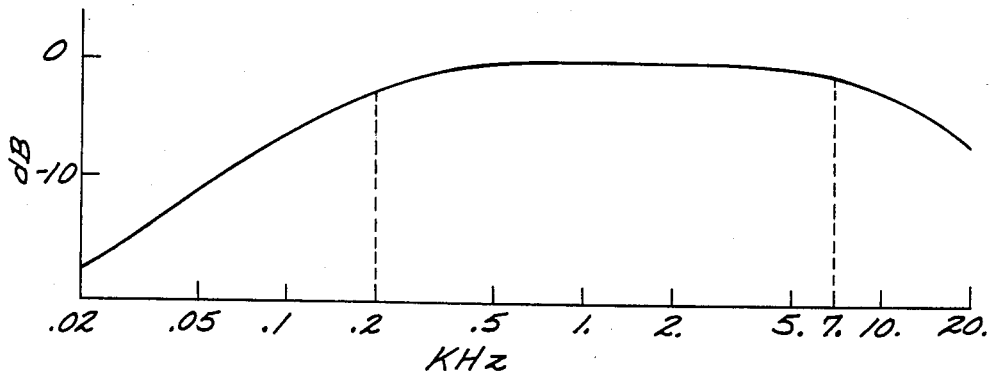

The sum signal (L+R) provided by the summing circuit 113 is coupled to a fixed sum signal equalizer 117. An appropriate equalization characteristic for the fixed sum signal equalizer 117 is shown in FIG. 5B. By way of example, the fixed sum signal equalizer 117 includes a bandpass filter which has −3 dB frequencies at 200 Hz and 7 KHz and rolls off at 6 dB per octave. The 200 Hz to 7 KHz bandwidth of the bandpass filter approximates the operating range of the dynamic sum signal equalizer 21 of the dynamic stereo image enhancement system 10 of FIG. 2.

It should be noted that the equalization characteristic of the fixed sum signal equalizer 117 rolls off below 200 Hz at 6 dB per octave to avoid overly emphasized bass. Moreover, there is very little difference signal in that range, so that the processed sum signal in that range does not have to be boosted very much.

As discussed further herein, further amplification of the processed sum signal $(L+R)_p$ is provided by a gain controlled amplifier 127 which also provides for artificial reverberation compensation. Such amplification may also be provided, at least in part, by the fixed sum signal equalizer 117.

The equalization characteristics of the fixed equalizers 115, 117 and the gains associated with the processed sum and difference signals are intended to approximate the average behavior of the dynamic enhancement system 10 of FIG. 1 for a large variety of recordings. Thus, the difference signal components in the frequency ranges that statistically include predominantly quiet components are boosted relative to the difference signal components in the frequency ranges that statistically include predominantly louder components. The louder components of the difference signal are typically in the mid-range, and the quieter components are on either side of the mid-range. Particularly, the difference signal components in the midrange are attenuated to a greater degree than the difference signal components on either side of the mid-range. The equalized signal is then boosted so that the difference signal components on either side of the mid-range are boosted relative to the difference signal components in the mid-range.

The enhancement system 110 further includes a feedback and reverberation control circuit 40 which is substantially similar to the feedback and reverberation control circuit 30 of FIG. 3. The control circuit 40 cooperates with other elements in the system to provide for automatic adjustment of stereo enhancement and for reverberation compensation.

The control circuit 40 is responsive to the difference signal (L−R) provided by the difference circuit 111 and the sum signal (L+R) provided by the summing circuit 113. The control circuit 40 provides a gain control signal CTRL for controlling the gain controlled amplifier 125 which varies the gain applied to the equalized difference signal provided by the fixed difference signal equalizer 115. The control circuit 40 is further responsive to the amplified and equalized difference signal provided by the gain controlled amplifier 125. Particularly, the output of the gain controlled amplifier 125 would be provided to the bandpass filter 36 of the control circuit 30 of FIG. 3.

The control circuit 40 controls the gain controlled amplifier 125 so as to maintain a constant ratio between the sum signal (L+R) provided by the summing circuit 113 and the difference signal provided by the processed gain controlled amplifier 125.

The control circuit 40 further provides a reverberation control signal RCTRL to the gain controlled amplifier 127 which provides for reverberation compensation. By way of example, the gain controlled amplifier 127 may be an appropriate voltage controlled amplifier.

Figure 11:
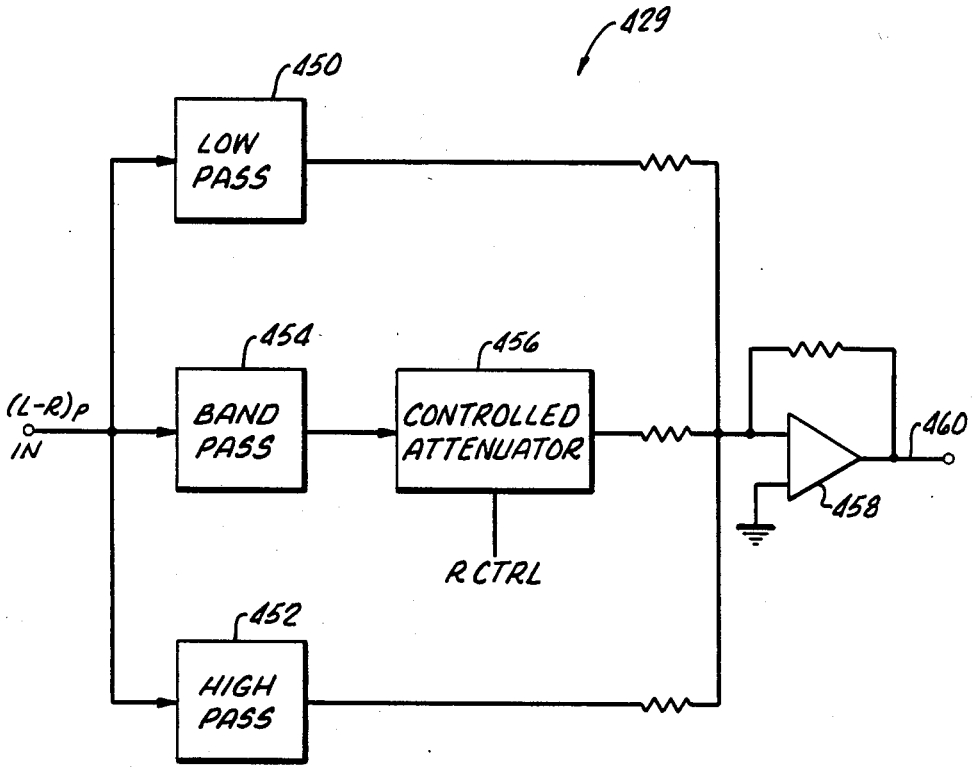
FIG. 11 shows an alternative attenuating reverberation filter.

The reverberation filter 129 is a variable rejection filter that includes two one octave wide filters respectively centered at 500 Hz and 1.5 KHz, and each having a low Q to provide sufficient bandwidth. Each of the filters of the reverberation filter 129 may be similar to one of the equalizer bands in the dynamic difference signal equalizer 19 of the dynamic stereo image enhancement system 10 of FIG. 2, and provides a maximum attenuation of 12 dB for the maximum level of the reverberation control signal RCTRL. An alternative reverberation filter is shown in FIG. 11 and described below.

By way of example, the gain controlled amplifier 125 may be an appropriate voltage controlled amplifier. The processed sum signal $(L+R)_p$ output of the gain controlled amplifier 127 is provided to a fixed terminal of a potentiometer 123 which has its other fixed terminal coupled to ground. The wiper contact of the potentiometer 123 is coupled to a mixer 121 which therefore receives the processed sum signal $(L+R)_p$ having a level controlled by the potentiometer 123.

The processed difference signal $(L-R)_p$ output of the reverberation filter 129 is coupled to a fixed terminal of a potentiometer 119 which has its other fixed terminal coupled to ground. The wiper contact of the potentiometer 119 is coupled to the mixer 121 which therefore receives the processed difference signal $(L-R)_p$ having a level controlled by the potentiometer 119.

The gain controlled amplifier 127 and the reverberation filter 129 are preferably controlled by the reverberation control signal RCTRL so that the resulting increase in the processed sum signal $(L-R)_p$ provided by the gain controlled amplifier 127 is less than the decrease in the processed difference signal $(L-R)_p$ provided by the reverberation filter 129. Increasing the level of the processed sum signal $(L+R)_p$ provided by the gain controlled amplifier 127 is to provide for a sufficient level of the processed sum signal $(L+R)_p$ to compensate for any artificial reverberation not sufficiently attenuated by the reverberation filter 129.

The left and right subsonically filtered input signals $L_{in}$ and $R_{in}$ are provided as further inputs to the mixer 121. The mixer 121 combines the processed difference signal $(L-R)_p$ and the processed sum signal $(L+R)_p$ with the left and right input signals $L_{in}$ and $R_{in}$ to provide left and right output signals $L_{out}$ and $R_{out}$. The mixer 121 may be similar to the mixer 25 of the dynamic stereo enhancement system 10 of FIG. 1, and would provide the left and right output signals $L_{out}$, $R_{out}$ in accordance with the following:

$$L_{out}=L_{in}+K_1(L+R)_p+K_2(L-R)_p \quad \text{(Equation 3)}$$

$$R_{out}=R_{in}+K_1(L+R)_p-K_2(L-R)_p \quad \text{(Equation 4)}$$

The value of $K_1$ is controlled by the potentiometer 123; and the value of $K_2$ is controlled by the potentiometer 119.

The potentiometers 119, 123 are user controlled elements to allow the user to control the levels of the processed difference signal $(L-R)_p$ and the processed sum signal $(L+R)_p$ that are mixed by the mixer 121. For example, the potentiometers 119, 123 may be adjusted to minimize the processed difference signal and to maximize the processed sum signal. With such adjustment, the listener would hear primarily any center stage soloist present in the recording being played.

The left and right output signals $L_{out}$ and $R_{out}$ are provided to the sound perspective correction system 200 of the stereo enhancement system 300 of FIG. 1 Alternatively, as discussed relative to FIG. 1, to the extent that the sound perspective correction system 200 is not utilized, the left and right output signals $L_{out}$ and $R_{out}$ are appropriately provided, for example, to the tape monitor loop input of the preamplifier that provided the left and right stereo signals L and R.

D. The Perspective Correction System

The sound perspective correction system 210 of FIG. 6 provides perspective correction for (a) speakers located in front of the listener ("front located speakers"); (b) headphones; and (c) speakers located to the side of the listener ("side located speakers"), such as those in automobile doors. As used herein, the term headphones shall refer to all headphones, including those sometimes characterized as airline headsets. Generally, headphones can be categorized as being (a) circumaural where the earcup surrounds the entire large outer ear known as the pinna, (b) supraaural where the earcup sits on the outer surface of the pinna, and (c) intraaural where the earcup fits within the entrance to the ear canal.

Referring specifically to FIG. 6, the sound perspective correction system 210 includes a summing circuit 211 and difference circuit 213 which are both responsive to left and right input $L_{in}$ and $R_{in}$ signals provided by a stereo image enhancement system as described above or by a stereo sound reproduction system (not shown). For example, as discussed above relative to the stereo enhancement system 300 of FIG. 1, the left and right input signals $L_{in}$ and $R_{in}$ may be provided by the preamplifier tape monitor loop output of such a stereo system.

The summing circuit 211 adds the left and right input signals $L_{in}$ and $R_{in}$ to provide a sum signal (L+R), and the difference circuit 213 subtracts the right signal $R_{in}$ from the left signal $L_{in}$ to provide a difference signal (L−R).

The sum signal (L+R) is provided to the input of a fixed sum signal equalizer 215 which provides for one equalization output that is coupled to the switchable terminal 2 of a two-position switch 217. The switchable terminal 1 of the two-position switch 217 is coupled to the output of the summing circuit 211. The switched terminal of the switch 217 provides a switched sum signal $(L+R)_s$.

The difference signal (L−R) is provided to the input of a fixed difference signal equalizer 221 which provides for one equalization output that is coupled to the switchable terminal 1 of a two-position switch 223. The switch 223 is ganged together with the switch 217 so that each is in the same corresponding position. The switchable terminal 2 of the switch 223 is coupled to the output of the difference circuit 213. The switched terminal of the switch 223 provides a switched difference signal $(L-R)_s$. The ganged two-position switches 217, 223 are controlled by the user, and are set as a function of whether (a) front located speakers are to be used, or (b) headphones or side located speakers are to be used. It should be readily apparent that in position 1, the fixed sum signal equalizer 215 is bypassed, and in position 2 the fixed difference signal equalizer 221 is bypassed.

The switched terminal of the switch 217 is connected as an input to a mixer 225, and the switched terminal of the switch 223 is also connected as an input to the mixer 225. The mixer 225 combines the switched sum signal $(L+R)_s$ and the switched difference signal $(L-R)_s$ to provide left and right output signals $L_{out}$ and $R_{out}$. Particularly, the left and right output signals $L_{out}$ and $R_{out}$ are provided by the mixer 225 in accordance with the following:

$$L_{out}=(L+R)_s+(L-R)_s \quad \text{(Equation 5)}$$

$$R_{out}=(L+R)_s-(L-R)_s \quad \text{(Equation 6)}$$

Position 1 of the switches 217, 223 corresponds to sum and difference signals for use with front located speakers. Position 2 of the switches 217, 223 corresponds to sum and difference signals for use with headphones or side located speakers, such as in an automobile.

From the foregoing it should be evident that only the difference signal is equalized when front located speakers are utilized, and that only the sum signal is equalized when headphones or side located speakers are utilized.

Referring again to the fixed sum signal equalizer 215 and to the fixed difference signal equalizer 221, each includes a plurality of equalization bands which are about one-third octave wide. The following Tables I and II set forth the respective center frequencies of such equalizer bands and the amount of equalization provided.

Table I sets forth the equalization provided by the fixed difference signal equalizer 221 for the output connected to the switchable terminal 1 of the switch 223. As discussed above, the fixed sum signal equalizer 215 is bypassed when the switches 217, 223 are in position 1 (front speakers).

TABLE I

| Center Freq | Difference Signal Equalizer |
|---|---|
| 500 Hz | +5.0 dB |
| 1 KHz | +7.5 dB |
| 8 KHz | +15.0 dB |

Table II sets forth the equalization provided by the fixed sum signal equalizer 215 for the output connected to the switchable terminal 2 of the switch 217. As discussed above, the fixed difference signal equalizer 221 is bypassed when the switches 217, 223 are in position 2 (headphones or side speakers).

TABLE II

| Center Freq | Sum Signal Equalizer |
|---|---|
| 500 Hz | −5.0 dB |
| 1 KHz | −7.5 dB |
| 8 KHz | −15.0 dB |

The values set forth in Table I are representative values only and may be modified on the basis of factors including speaker location and speaker characteristics. Similarly, the values set forth in Table II are representative values only, and with side located speakers may be modified on the basis of factors including speaker location and speaker characteristics. With headphones, the values of Table II may also be modified on the basis of factors including the type of headphone, as well as specific headphone characteristics.

It should be noted that the equalization for headphones may differ from the equalization for side placed speakers. With side located speakers, the sound reaches the ear with little interference. However, with headphones, the combined structure of the headphones and the ear influences the spectrum of the sound reaching the eardrum. Moreover, the concha (the section leading into the ear canal) and part of the ear canal may be occluded by the headphone structure, which would further influence the spectrum of sound reaching the eardrum. A discussion of the effects of airline entertainment headsets on sound reproduction is set forth in "Some Factors Affecting the Performance of Airline Entertainment Headsets," S. Gilman, J. Audio Eng. Soc., Vol. 31, No. 12, December 1983, pp. 914–920.

Figure 7A:
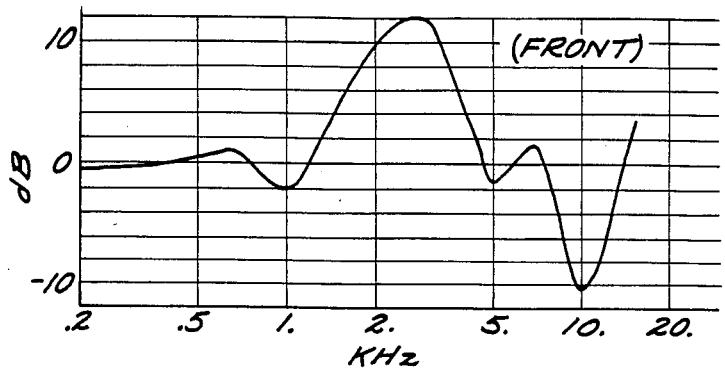
FIGS. 7A and 7B are frequency responses of the human ear which are helpful in understanding stereo image enhancement systems of FIGS. 2 and 4 and the sound perspective correction system of FIG. 5.
Figure 7B:
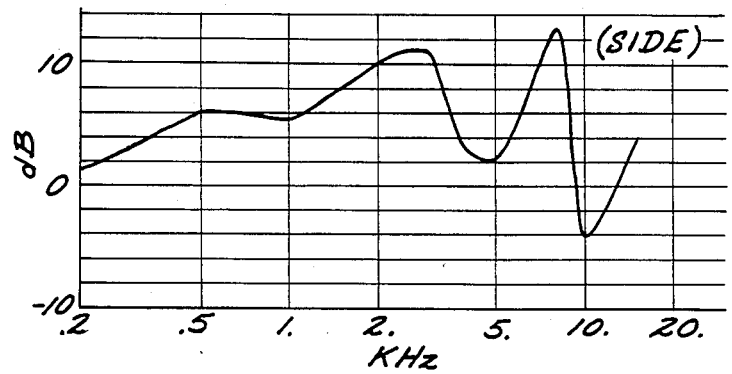

The equalization provided by the sound perspective control system 210 can be further understood by reference to FIGS. 7A through 7D. FIG. 7A represents a statistical average frequency response of the human ear to sound emanating from zero degrees azimuth or straight ahead (herein the "front response"). FIG. 7B represents a statistical average frequency response of the human ear for sound emanating from 90 degrees azimuth as measured relative to straight ahead (herein the "side response").

Figure 7C:
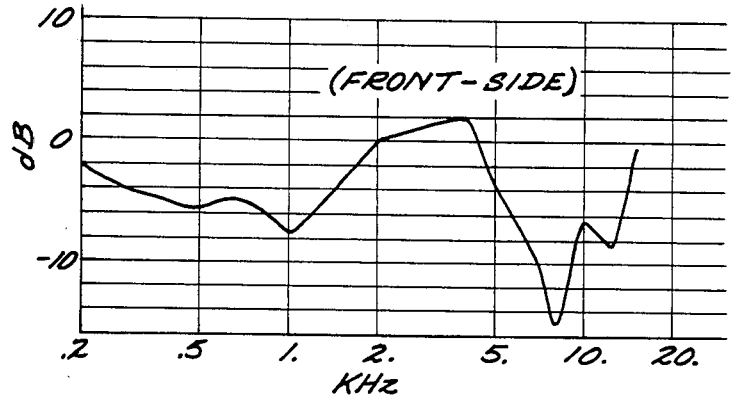
FIG. 7C is the frequency response of FIG. 7A relative to FIG. 7B.

FIG. 7C is the front response relative to the side response, i.e., the response of FIG. 7A (front) minus the response of FIG. 7B (side). Equalization is required for sounds which should be emanating from the front but with side located speakers or headphones are emanating from the sides. The response of FIG. 7C is indicative of the equalization that would restore front sounds to their appropriate levels when such sounds are reproduced by side located speakers or headphones.

Figure 7D:
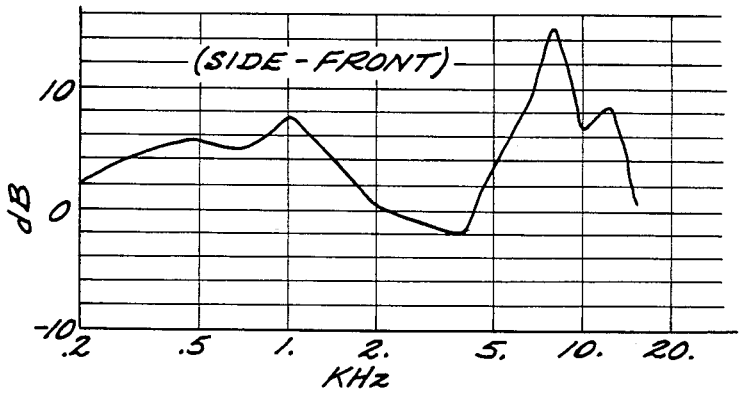
FIG. 7D is the frequency response of FIG. 7B relative to FIG. 7A.

FIG. 7D is the side response relative to the front response, i.e., the response of FIG. 7B (side) minus the response of FIG. 7A (front) provides the response of FIG. 7D. Equalization is required for sounds which should be emanating from the sides but are emanating from the front. The response of FIG. 7D is indicative of the equalization that would restore side sounds to their appropriate levels when such sounds are reproduced by forward placed speakers.

The equalization characteristics of the equalizers 215, 221 are based on the response of FIGS. 7C and 7D, but do not provide the entire equalization indicated by such responses. It has been determined that equalization bands of one-third octave widths respectively centered at 500 Hz, 1 KHz, and 8 KHz are sufficient. The characteristics of each equalization band have been discussed previously.

The foregoing has been a disclosure of a stereo sound perspective correction system which provides for a stereo image having a corrected stereo sound perspective. It is readily utilized with or without the disclosed stereo image enhancement systems. Its use with a stereo image enhancement system would provide for a stereo image which is wider, a greater listening area when used with speakers, and proper sound perspective.

The disclosed implementation of the sound perspective correction system of the invention is not complex and effectively utilizes only a few narrow equalization bands. As discussed above, the relative responses of the front and side responses to one another tend to indicate that wider ranges of equalization should be utilized, but the few narrow equalization bands have been found to be a reasonable approximation over the entire audio bandwidth.

Figure 8:
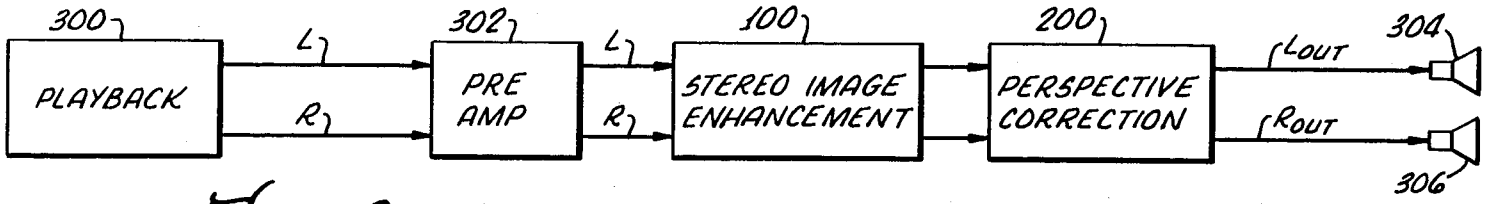
FIGS. 8 and 9 illustrate sound reproducing and sound recording systems respectively, each of which employs either or both of the stereo image enhancement and perspective correction arrangements embodying principles of the present invention.

As previously mentioned, principles of the present invention are applicable either for playback of conventional stereo sound recordings or for the manufacture of unique stereo sound recordings which will provide advantges described above when played back through conventional sound responsive systems. Thus, as illustrated in FIG. 8, for playback of a conventional sound recording, an exemplary system having the enhancement described herein includes a conventional playback apparatus 300 which may respond to a digital record, such as a laser disc, a phonograph record, a magnetic tape, or the sound channel on video tape or motion picture film. The playback apparatus provides left and right channel stereo signals L, R to a preamplifier 302 from which the left and right signals are fed to the stereo image enhancement system 100 described above to provide processed output signals $L_{out}$ and $R_{out}$ fed either directly to a pair of conventional loudspeakers 304, 306 or fed to the speakers via the perspective correction system 200 previously described.

A similar arrangement is used in making a recording that will itself bear data in the form of physical grooves of a phonograph record, magnetic domains of a magnetic tape or like medium, or digital information that may be read by optical means. Such data defines left and right stereo signals formed of signal components that, when played back on a conventional sound reproducing system, produce all of the advantages described above. Thus, as illustrated schematically in FIG. 9, a recording system for making a sound recording embodying principles of the present invention may receive left and right stereo input signals from either a pair of microphones 310 or a conventional stereo playback system 312 which is adapted to provide left and right stereo input signals L, R. The playback system 312, like the system 300 of FIG. 8, may provide its output signals from any conventional record medium including digital records such as a laser disc, phonograph records, magnetic tape, or video or film sound track media.

Figure 9:
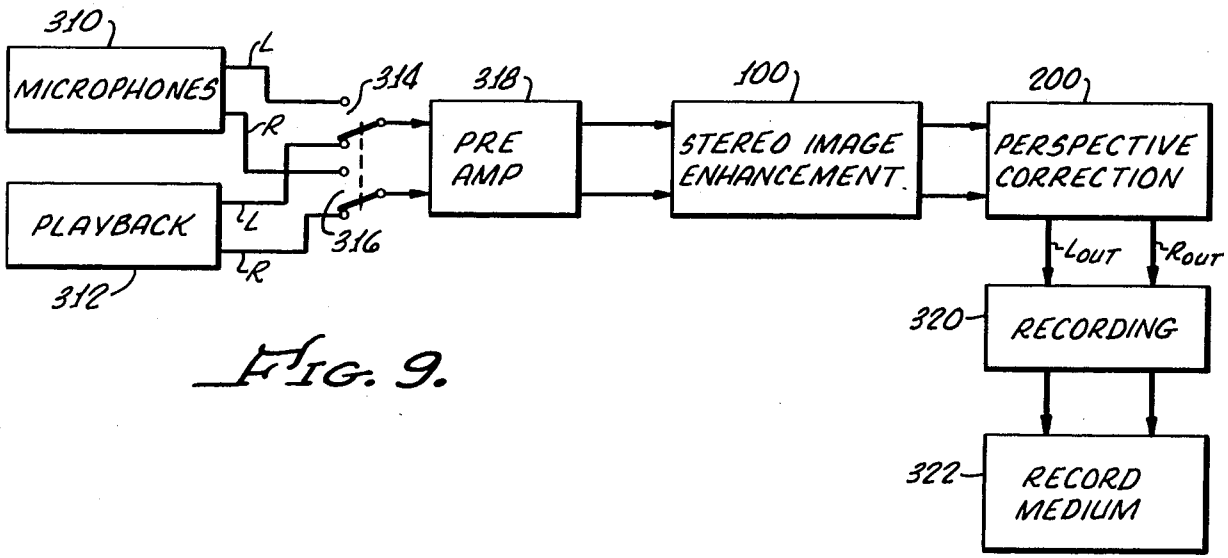

Ganged switches 314, 316 schematically indicate in FIG. 9 that the system may use either left and right signals from a playback device or the left and right signals from a pair of microphones. These signals are fed to a preamplifier 318 and thence to the stereo image enhancement circuit 100 described above. From the stereo image enhancement circuit 100, the processed left and right output signals are fed either directly to a recording device 320 or indirectly to the recording device via the above described perspective correction circuit 200. The recording device conventionally records the left and right output signals $L_{out}$ and $R_{out}$ on a record medium 322 which may be any one of the record medium types commonly employed. It will be noted that the output signals $L_{out}$ and $R_{out}$ that are fed to recording device 320 are derived, in the case of the stereo image enhancement, from mixer 25 of FIG. 2 or mixer 21 of FIG. 4, or in the case of the perspective correction from the mixer 225 of FIG. 6.

The output signal $L_{out}$ recorded on the medium 322 includes the several left channel output signal components described, namely the described combination of $L_{in}+K_1(L+R)_p+K_2(L-R)_p$ for the left channel output. Similarly, the output signal $R_{out}$ is recorded upon the record medium by the recording apparatus and includes the components described above as $R_{in}+K_1(L+R)_p-K_2(L-R)_p$.

The record medium 322, when recorded with the arrangement illustrated in FIG. 9, is simply played back on a conventional sound recording responsive device to provide the above-described advantages. These advantages are derived from the fact that the record medium so produced embodies signal-producing means that cooperates with the sound recording responsive device to produce left and right output signals that comprise a combination of signal components including a processed difference signal and a processed sum signal. The processed difference signal is a modification of an input difference signal formed in the stereo image enhancement circuit 100. This input difference signal represents the difference of the left and right input signals L and R, and as previously described, has relative amplitudes of certain components modified to boost those of its components that are within frequency bands wherein the input difference signal has lowest amplitude relative to those components of such input difference signal that are within frequency bands wherein the input difference signal components have highest amplitude. Similarly, the recording will produce a right stereo output signal component as a processed sum signal formed in the stereo image enhancement ciruit 100. This processed sum signal component is a modification of the sum of the left and right channel input signals, and, as previously described, has relative amplitudes of certain components modified to boost those of its components in frequency bands where the input difference signal has higher amplitudes relative to those components of the input sum signal that are within frequency bands where the difference signal has lower amplitude. Thus, the record cooperates with the sound responsive system to cause the speakers to produce left and right stereo signals each having sum and difference components wherein amplitudes of such components are relatively deemphasized or boosted, respectively, within those frequency bands wherein the difference signal has lower amplitudes. Moreover, the operation of the gain control amplifier 22 and control circuit 30 of FIG. 2, and the corresponding circuits of FIG. 4 cause the stereo output signals produced by playback of record 322 to have a substantially constant ratio of the sum signal to the modified or processed difference signal, all as previously described.

When the system of FIG. 9 is employed to make a record having perspective correction in addition to or instead of image enhancement, such a record will cooperate with the conventional stereo player to produce left and right stereo output signals having components including a processed sum signal which are increasingly attenuated in frequency bands centered on 500 Hz, 1 KHz and 8 KHz, respectively, as described above, and a component comprising a difference signal. Such a record is made specifically to be played back through a system including side mounted speakers. Where a perspective corrected record made with the system of FIG. 9 is specifically made for playback in a system with front mounted speakers, the record when played back on a stereo player will provide left and right stereo output signals wherein one output signal has components comprising a sum signal and a component comprising a difference signal, where such difference signal has amplitudes thereof increasingly boosted in frequency bands centered respectively at 500 Hz, 1 KHz and 8 KHz, as described above. Stated otherwise, the recording having perspective correction for front speakers, when played in a stereo player, produces a left output signal which is formed of the sum of a first component comprising the sum signal and a second component comprising the processed difference signal as set forth in equation 5 above and will provide a right output stereo signal formed of the difference between the sum signal and the processed difference signal as set forth in equation 6 above. When such a recording is made for use with side mounted speakers, only the sum signals in equations 5 and 6 are equalized whereas when the recording is made for use with front mounted speakers only the difference signals of equations of 5 and 6 are equalized.

It will be seen that a method of making unique stereo sound recordings having stereo image enhancement, or perspective correction, or both may be carried out by the apparatus illustrated in FIG. 9. The method generally comprises combining left and right input signals to generate sum and difference signals, and creating a processed sum signal by selectively altering relative amplitudes of components of the sum signal within respective predetermined frequency bands so as to enhance those of the sum signal components which are within frequency bands of highest difference signal component amplitudes relative to those of the sum signal components which are within frequency bands of lowest difference signal component amplitudes. The method also includes the step of creating a processed difference signal by selectively alterating the relative amplitude of components of the difference signal within the predetermined frequency bands so as to deemphasize those of the difference signal components which are within frequency bands where difference signal components are highest relative to those of the difference signal components which are within frequency bands wherein the difference signal components are lowest. The method also combines the left and right signals with the processed sum and difference signals to provide enhanced right and left output signals which are fed to a sound recording device to make a sound recording. Other features of the method include the described electronic analysis of the frequency spectrum of the difference signal and generation of control signals as a function of the amplitudes of the difference signal within respective predetermined frequency bands, and utilizing the control signals to determine the extent to which amplitudes of components of the sum and difference signals are altered within the respective frequency bands.

According to an important aspect of the method described herein, right and left signals are added and subtracted to generate sum and difference signals, a dynamic control signal is generated representing the amount of stereo in the input signals, the sum and difference signals are processed for enhancement of the output signals and at least one of the processed signals is modified in accordance with the amount of stereo in the input signals. A specific feature of this aspect of the method involves modification of one of the processed signals, which is accomplished so as to maintain a constant ratio between one of the sum and difference signals and the processed signal. In use of the described method, for making a recording that is corrected for perspective with side mounted speakers, left and right signals are combined to provide sum and difference signals, the sum signal is equalized as previously described and combined with the unprocessed difference signal to provide a left output formed of the sum of the processed sum signal and the unprocessed difference signal and to form a right output signal comprising the difference between the processed sum signal and the unprocessed difference signal. These output signals are fed to the recording mechanism to provide a record medium having perspective correction for side mounted speakers.

For front mounted speakers, a perspective corrected record medium is made by combining the right and left input signals to provide sum and difference signals, equalizing the difference signal as previously described, and combining the unprocessed sum signal with the equalized difference signal to provide a left output formed of the sum of the unprocessed sum signal and the processed or equalized difference signal and to provide a right output signal formed of the difference between the unprocessed sum signal and the equalized difference signal. These output signals are fed to a recording mechanism to produce a record medium having perspective correction for front speakers.

A record made by the apparatus and method described herein is uniquely distinguished from other stereo records in that unique signal generating data is embodied in the record. Whether such data is in the form of variable magnetic elements, varying grooves of a phonograph record or digital information such as variations in optical reflectivity of a laser or digital disc, for example, the unique aspects of such a record medium are readily recognizable. Upon playback of such an unique record by conventional record playing medium, stereo sound will be produced having all of the above-described advantages and composed of the specified signal components.

The amount of enhancement is continually and automatically adjusted by control circuit 30 and gain controlled amplifier 22 to compensate for variation in the amount of stereo information from one recording to another when using the described system for playback of conventional recordings. So too, such continuous and automatic adjustment is embodied in a recording made as indicated in FIG. 9. Thus, if the stereo information contained in a record employed in the playback system 312, or, if the stereo information reaching the microphone pair 310, should vary either from one recording to the next or should vary during any given performance or recording, the described control circuit 30 and gain control amplifier 22 will result in adjustment of the amount of enhancement in the information recorded on the record medium 322 and, therefore, result in such adjustment of output signals when record medium 322 is played back in a conventional system.

As described above and illustrated in FIG. 4, where fixed sum and difference equalizers are employed, amplitude of the processed sum channel signal is boosted, and certain frequencies of the processed difference signal are attenuated under control of the reverberation control signal RCTRL. This arrangement provides automatic control of the amount of reverberation by automatically increasing the level of the processed sum channel signal and concomitantly decreasing the level of certain frequencies of the difference channel signal. These increases and decreases in signal levels are effected in the reverberation bands, as described above, to reduce boost of natural or artificial reverberation that may be present, which boost is provided by the enhancement circuits described herein. A similar reverberation control is also described above in connection with the arrangement illustrated in FIG. 2, in which the reverberation control signal is employed to cause the dynamic difference signal equalizer 19 to provide further attenuation in the reverberation bands and to cause the dynamic sum signal equalizer 21 to provide further boost to the sum signal components.

Reverberation control illustrated in FIG. 2 may be considerably improved by providing an automatic reverberation control through the use of a gain controlled amplifier in the sum channel and an attenuating reverberation filter in the difference channel. Such an improved arrangement is illustrated in FIG. 10, which shows a system substantially similar to that illustrated in FIG. 2, having many of the same components. Components which are the same in both FIGS. 2 and 10 are designated by the same reference numerals with the corresponding components of FIG. 10 having the prefix "4" so that for example, summing circuit 13 of FIG. 2 is the same as summing circuit 413 of FIG. 10. The arrangement of FIG. 10 differs from that of FIG. 2 generally by providing an automatically and manually controllable reverberation control signal, which is employed to control a gain controlled sum channel amplifier 440, and the addition of a reverberation signal controlled reverberation filter 429 (analogous to reverberation filter 129 of the fixed equalizer arrrangement of FIG. 4) to handle the processed difference signal. In the circuit of FIG. 10 the tendency of the described enhancement circuits to provide excessive emphasis of reveberation in the inputs is automatically and selectively restrained.

Control circuit 430 is identical to the control circuit illustrated in FIG. 3 but the reverberation signal, RCTRL, provided from this circuit is derived from the manually adjustable wiper arm 442 of a reverberation control potentiometer 444, to which is fed the reverberation control signal from the output of amplifier 59 of FIG. 3. The reverberation control signal from wiper 442 is fed to control the gain of the gain controlled amplifier 440 to which is fed the output $(L+R)_p$ of dynamic sum signal equalizer 421. The output of gain controlled amplifier 440 is fed to a potentiometer 427 for input to the mixer 425, just as described in connection with the output of dynamic sum signal equalizer 21 of FIG. 2. In this case the reverberation control signal is not fed to the dynamic difference signal equalizer nor to the dynamic sum signal equalizer directly.

The processed difference signal from the output of gain controlled amplifier 422 is fed to the input of a reverberation filter 429 of which the output is fed to potentiometer 423 and thence to mixer 425 just as described in connection with the output of gain controlled amplifier 22 of FIG. 2.

The reverberation filter 429 may be the same as reverberation filter 129 illustrated in FIG. 4. However, it is presently preferred to employ a reverberation filter arranged as illustrated in FIG. 11, which is basically a variable attenuation band reject filter. As illustrated in FIG. 11, the processed difference signal $(L-R)_p$ is fed to the filter input and thence in parallel to a lowpass filter 450, a highpass filter 452, and a bandpass filter 454. The output of the bandpass filter 454 is fed to a controlled attenuating circuit 456 having the reverberation control RCTRL as its controlling input. The three outputs, from filters 450 and 452 and from the attenuator 456, are combined and fed to the inverting input of a differential amplifier 458 having its noninverting input grounded, thus providing at its output 450 the gain controlled and reverberation filter controlled processed difference signal to be fed to the potentiometer 423. The filter sections of the reverberation filter 429 collectively provide a lowpass up to about 250 hertz, a highpass above about 4 kilohertz, and a controlled attenuation bandpass between about 400 hertz and 2.5 kilohertz.

Therefore, in a manner similar to the operation of the fixed equalization arrangement of FIG. 4, the circuit of FIG. 10 provides for sensing of the amount of reverberation, whether natural or artificial, in the input signals and provides a reverberation control signal RCTRL based upon such sensed reverberation. The control signal RCTRL boosts the processed sum signal and attenuates a frequency band of the processed difference signal so as to automatically control the effect of the described enhancement system on the amount of reverberation in the input signal. The automatic control of reverberation is manually selectable by manual control of the potentiometer 444, a feature that is of great importance in the recording industry. Close selective adjustment of the amount of reverberation is required in making a recording, and in particular in making a new or re-recording of an old recording. Thus any undesired enhancement of reverberation that may be introduced by the described enhancement circuitry is readily avoided by the automatic control of both sum and difference channels and by the manually selectable control of the level of the reverberation control signal itself. Of course the manual control of the level of the reverberation control signal as illustrated in FIG. 10 may be readily applied to obtain manual control of the level of the reverberation control signal RCTRL shown in the circuit of FIG. 4, which is fed to control the reverberation filter 129.

Overall, the foregoing has been a disclosure of systems for substantially improving the stereo image resulting from recorded performances, both in playback of conventional records and in the production of improved recordings. Such systems are readily utilized with standard audio equipment and are readily added to installed audio equipment. Further, the disclosed systems may be easily incorporated into preamplifiers and/or integrated amplifiers. Such incorporation may include provisions for bypassing the disclosed systems.

The disclosed stereo enhancement system is readily implemented using analog techniques, digital techniques, or a combination of both. Further, the disclosed stereo enhancement system is readily implemented with integrated circuit techniques.

Also, the disclosed systems may be utilized with or incorporated into a variety of audio systems including airline entertainment systems, theater sound systems, recording systems for producing recordings which include image enhancement and/or perspective correction, and electronic musical instruments such as organs and synthesizers.

Further, the disclosed systems would be particularly useful in automotive sound systems, as well as sound systems for other vehicles such as boats.

Although the foregoing has been a description and illustration of specific embodiments of the invention, various modifications and changes thereto can be made by persons skilled in the art without departing from the scope and spirit of the invention as defined by the following claims.

What is claimed is:

1. A stereo image enhancement system for use in a stereo system having respective left and right signals, comprising:

means for providing the sum of the left and right signals as a sum signal and for providing the difference between the left and right signals as a difference signal;

processing means responsive to said sum and difference signals for selectively altering the relative amplitudes of components of said difference signal within respective predetermined frequency bands so as to boost difference signal components as an inverse function of the level of difference signal components within said respective frequency bands to provide a processed difference signal, and for selectively altering the relative amplitudes of components of said sum signal within said respective predetermined bands so as to boost sum signal components as a function of the level of difference signal components within said respective frequency bands to provide a processed sum signal; and means for combining said processed difference signal, said processed sum signal, and the left and right signals to provide left and right output signals.

2. The stereo image enhancement system of claim 1 wherein said processing means comprises:

analytical means for analyzing the frequency spectrum of said difference signal for providing control signals respectively associated with said predetermined frequency bands as a function of the amplitudes of components of said difference signal within said respective frequency bands;

first equalizing means responsive to said control signals for attenuating components of said difference signal as a function of said control signals so that louder components of said difference signal are attenuated more than quieter components of said difference signal;

second equalizing means responsive to said control signals for boosting components of said sum signal within said predetermined frequency bands as a function of said control signals to provide said processed sum signal; and control means for amplifying said attenuated difference signal to provide said processed difference signal.

3. The stereo image enhancement system of claim 2 wherein said first equalizing means further provides predetermined fixed attenuation of selected difference signal components.

4. The stereo image enhancement system of claim 3 wherein said selected difference signal components include difference signal components between 1 KHz and 4 KHz.

5. The stereo image enhancement system of claim 2 wherein said control means amplifies said attenuated difference signal as a function of the magnitude of the said processed difference signal relative to that of the sum signal to provide a substantially consistent stereo image for differing amounts of stereo information contained in said left and right signals.

6. The stereo image enhancement system of claim 5 wherein said control means maintains said processed difference signal and said sum signal at a constant ratio.

7. The stereo image enhancement system of claim 6 wherein said control means comprises:

means for amplifying said attenuated difference signal to provide said processed difference signal; and gain control means responsive to said sum signal and said processed difference signal for controlling the gain of said amplifying means to maintain said constant ratio.

8. The stereo image enhancement system of claim 2 wherein said control means further monitors the relative magnitudes of said sum signal and said difference signal to detect conditions indicative of the presence of artificial reverberation, and controls said second equalizing means pursuant to detection of conditions indicative of the presence of artificial reverberation to compensate the effects of artificial reverberation.

9. The stereo image enhancement system of claim 8 wherein said control means controls said second equalizing means to provide further attenuation in selected ones of said predetermined frequency bands pursuant to detection of conditions indicative of the presence of artificial reverberation.

10. The stereo image enhancement system of claim 9 wherein said control means further controls said first equalizing means pursuant to detection of conditions indicative of the presence of artificial reverberation to compensate the effects of artificial reverberation.

11. The stereo image enhancement system of claim 10 wherein said control means controls said first equalizing means to provide further boost in selected ones of said predetermined frequency bands pursuant to detection of conditions indicative of the presence of artificial reverberation.

12. The stereo image enhancement system of claim 11 wherein said control means monitors the ratio between said sum signal and said difference signal, and controls said first equalizing means and said second equalizing means when said ratio exceeds a predetermined value.

13. The stereo enhancement system of claim 2 wherein said analytical means comprises a spectrum analyzer.

14. The stereo enhancement system of claim 13 wherein said first and second equalizing means respectively comprise a first multi-band dynamic equalizer and a second multi-band dynamic equalizer.

15. The stereo enhancement system of claim 14 wherein said spectrum analyzer and said first and second multi-band dynamic equalizers respectively include predetermined frequency bands centered at 125 Hz, 250 Hz, 500 Hz, 1 KHz, 2 KHz, 4 KHz, and 8 KHz.

16. A stereo enhancement system for use with a stereo sound reproduction system having respective left and right signals, comprising:

means for providing the difference between the left and right signals as a difference signal and for providing the sum of the left and right signals as a sum signal;

analytical means responsive to said difference signal for determining the frequency content of said difference signal;

first equalizing means responsive to said analytical means for selectively attenuating components of said difference signal as a function of the frequency content of said difference signal to provide a processed difference signal, said first equalizing means being effective to boost artificial reverberation in said difference signal;

second equalizing means responsive to said analytical means for selectively boosting components of said sum signal as a function of the frequency content of corresponding components of said difference signal to provide a processed sum signal;

enhancement and reverberation control means for controlling the ratio between said sum signal and said processed difference signal, and for controlling said first and second equalizing means to compensate for said boost of artificial reverberation; and means for selectively combining said processed sum signal, said processed difference signal, and the left and right signals to provide left and right output signals.

17. A stereo enhancement system for use with a stereo sound reproduction system having respective left and right signals, comprising:

means for providing the difference between the left and right signals as a difference signal and for providing the sum of the left and right signals as a sum signal;

processing means responsive to said sum and difference signals for selectively altering the relative amplitudes of components of said difference signal so as to boost selected difference signal components relative to other difference signal components to provide a processed difference signal, and for selectively altering the relative amplitudes of components of said sum signal so as to boost selected sum signal components relative to other sum signal components to provide a processed sum signal; and means for combining said processed sum and difference signals and the left and right signals to provide processed left and right signals.

18. The stereo enhancement system of claim 17 wherein said processing means comprises:

first equalizing means for selectively attenuating difference signal components so as to attenuate frequencies that statistically include louder components more than frequencies that statistically include quieter components; and second equalizing means for selectively passing sum signal components within a predetermined frequency range which statistically includes said louder difference signal components, and for attenuating sum signal components outside said predetermined frequency range;

control means for amplifying said selectively passed sum signal to provide said processed sum signal and for amplifying said selectively attenuated difference signal to provide said processed difference signal.

19. The stereo enhancement system of claim 18 wherein said first and second equalizing means respectively include a first fixed equalizer and a second fixed equalizer.

20. The stereo enhancement system of claim 18 wherein said control means selectively amplifies said selectively attenuated difference signal as a function of its magnitude relative to that of the sum signal to provide a substantially consistent stereo image for differing amounts of stereo information in said left and right signals.

21. The stereo enhancement system of claim 20 wherein said control means maintains said amplified difference signal and said sum signal at a constant ratio.

22. The stereo enhancement system of claim 21 wherein said control means comprises:

means for amplifying said selectively attenuated difference signal; and gain control means responsive to said sum signal and said amplified difference signal for controlling the gain of said amplifying means to maintain said constant ratio.

23. The stereo enhancement system of claim 18 wherein said processing means is effective to boost artificial reverberation in said difference signal, and wherein said control means monitors the relative magnitudes of said sum signal and said difference signal to detect conditions indicative of the presence of artificial reverberation, and further filters said amplified difference signal to compensate for said boost of artificial reverberation.

24. The stereo enhancement system of claim 23 wherein said control means further includes a variable rejection filter for variably attenuating selected components of said amplified difference signal to compensate the effects of artificial reverberation.

25. The stereo enhancement system of claim 24 wherein said control means further amplifies said selectively passed sum signal to compensate the effects of artificial reverberation.

26. The stereo enhancement system of claim 25 wherein said control means includes a gain controlled amplifier for amplifying said selectively passed sum signal to compensate the effects of artificial reverberation.

27. The stereo enhancement system of claim 26 wherein said control means monitors the ratio between said sum signal and said difference signal, and controls said variable rejection filter and said gain controlled amplifier when said ratio exceeds a predetermined amount.

28. A sound perspective correction system for use in a stereo system having respective left and right signals, comprising:

means for providing the sum of the left and right signals as a sum signal and for providing the difference between the left and right signals as a difference signal;

first means for equalizing said sum signal within predetermined frequency bands to provide a processed sum signal, said first equalizing means selectively attenuating said sum signal within said predetermined frequency bands when the sound perspective correction system is utilized with headphones or speakers located to the sides of the listener;

second means for equalizing said difference signal within said predetermined frequency bands to provide a processed difference signal, said second equalizing means selectively boosting said difference signal within said predetermined frequency bands when the sound perspective correction system is utilized with speakers located in front of the listener; and means for combining either (a) said processed sum signal and said difference signal, or (b) said sum signal and said processed difference signal to provide processed left and right signals.

29. The second perspective correction system of claim 28 wherein said first equalizing means includes a first fixed equalizer, and wherein said second equalizing means includes a second fixed equalizer.

30. The sound perspective correction system of claim 29 wherein said first and second fixed equalizers have equalization bands of about one-third octave width.

31. The sound perspective correction system of claim 30 wherein said first and second fixed equalizers, respectively, have three equalization bands.

32. The sound perspective correction system of claim 31 wherein said three equalization bands are centered at 500 Hz, 1 KHz, and 8 KHz.

33. A method of deriving stereo enhanced signals from the left and right signals of a stereo sound system comprising the steps of:

a. electronically added said left and right signals so as to generate a sum signal, and electronically subtracting one of said left and right signals from the other to generate a difference signal;

b. creating a processed sum signal by selectively altering the relative amplitudes of components of said sum signal within respective predetermined frequency bands so as to enhance those of said sum signal components which are within frequency bands of highest difference signal component amplitudes relative to those of said sum signal components which are within frequency bands of lowest difference signal component amplitudes;

c. creating a processed difference signal by selectively altering the relative amplitudes of components of said difference signal within said predetermined frequency bands so as to deemphasize those of said difference signal components which are within frequency bands wherein said difference signal components are highest relative to those of said difference signal components which are within frequency bands wherein said difference signal components are the lowest; and d. combining said left and right signals with said processed difference signal, and with said processed sum signal to provide stereo enhanced left and right output signals.

34. The method of claim 33 wherein said steps of creating processed sum and difference signals are augmented by the step of electronically analyzing the frequency spectrum of said difference signal and generating a set of control signals as a function of the amplitudes of said difference signal within said respective predetermined frequency bands, and utilizing said control signals to determine the extent to which the amplitudes of components of said sum and difference signals are altered within said respective frequency bands.

35. The method of claim 33 including the additional step of continually and automatically amplifying said processed difference signal as a function of its magnitude relative to that of said sum signal so as to maintain a substantially consistent stereo separation between said left and right signals for differing amounts of stereo information within said left and right signals.

36. The method of claim 35 wherein said step of continually and automatically amplifying said processed difference signal is performed so as to maintain a constant ratio between said processed difference signal and said sum signal.

37. The method of claim 33 wherein said step of creating a processed difference signal boosts artificial reverberation information in said difference signal, and including the additional step of selectively boosting components of said sum signal, and selectively attenuating components of said difference signal within selected ones of said predetermined frequency bands in order to compensate for inappropriate boosting of artificial reverberation information in said difference signal.

38. The method of claim 35 wherein said step of continually and automatically amplifying is accomplished by averaging the sum of (a) the inverted peak envelope of said sum signal, and (b) the non-inverted peak envelope of said difference signal so as to generate a reverberation control signal, and boosting and attenuating components of said sum and difference signals, respectively, as a function of said reverberation control signal.

39. The method of claim 33 wherein the step of combining each of said left and right signals with said processed difference signal and with said processed sum signal is in accordance with the equations:

$$L_{out}=L_{in}+K_1(L+R)_p+K_2(L=R)_p,$$

and $$R_{out}=R_{in}+K_1(L+R)_p+K_2(L-R)_p,$$

where $L_{out}$=stereo enhanced left output signal,
$R_{out}$=stereo enhanced right output signal,
$(L+R)_p$=processed sum signal,
$(L-R)_p$=processed difference signal,
$L_{in}$32 left signal,
$R_{in}$=right signal,
$K_1$=first independent variable, and
$K_2$=second independent variable.

40. The method of claim 33 wherein the step of creating a processed sum signal is performed by selectively boosting said sum signal components in given ones of said frequency bands in direct proportion to the magnitude of said difference signal components in said given ones of said frequency bands.

41. The method of claim 40 wherein the step of creating a processed difference signal is performed by selectively boosting said difference signal components in given ones of said frequency bands in inverse proportion to the magnitude of said difference signal components in said given ones of said frequency bands.

42. A method of deriving stereo enhanced signals from the left and right signals of a stereo sound system comprising the steps of:

a. electronically adding said left and right signals so as to generate a sum signal, and electronically subtracting one of said left and right signals from the other to generate a difference signal;
b. creating a processed sum signal by selectively altering the relative amplitudes of components of said sum signal so as to boost selected sum signal components relative to other sum signal components;
c. creating a processed difference signal by selectively altering the relative amplitudes of components of said difference signal so as to boost selected difference signal components relative to other difference signal components; and
d. combining said left and right signals with said processed difference signal, and with said processed sum signal to provide stereo enhanced left and right output signals.

43. The method of claim 42 wherein said step of creating a processed sum signal includes the steps of:

filtering said sum signal so that components outside a predetermined frequency range which statistically includes difference signal components are attenuated; and
amplifying the filtered sum signal.

44. The method of claim 42 wherein said step of creating a processed difference signal includes the steps of:

selectively attenuating difference signal components so as to attenuate frequencies that statistically include louder components more than frequencies that statistically include quieter components; and
amplifying the selectively attenuated difference signal signal so as to boost selected difference signal components relative to other difference signal components.

45. A sound perspective correction system for use with a stereo sound reproduction system having respective left and right signals, comprising means for providing the sum of the left and right signal as a sum signal and providing the difference between the left and right signals as a difference signal;
first means for equalizing said sum signal within predetermined frequency bands to provide a processed sum signal, said first equalizing means including means for selectively attenuating said sum signal within said predetermined frequency bands to provide for perspective correction;
second means for equalizing said difference signal within said determined frequency bands to provide a processed difference signal, said second equalizing means including means for selectively boosting said difference signal within said predetermined frequency bands;
a mixer having first and second inputs and providing left and right perspective corrected output signals,
first switch means for alternatively coupling either said sum signal or said equalized sum signal to said first mixer input, and
second switch means connected for operation together with said first switch means for alternatively coupling either said difference signal or said equalized difference signal to the second input of said mixer, whereby the sound perspective correction system may be utilized with speakers located in front of or to the sides of a listener according to the position of said first and second switch means.

46. The stereo image enhancement system of any one of claims 1 through 5, 7, 10 and 15, including right and left speakers connected to receive said left and right output signals respectively.

47. The stereo image enhancement system of any one of claims 1 through 5, 7, 10 and 15 including recording means responsive to said means for combining said processed difference signals for recording said left and right output signals on a record medium.

48. The method of any one of claims 33, 34, 35, 36 and 38 including the step of transducing said stereo enhanced left and right output signals into left and right output sound signals.

49. The method of any one of claims 33, 34, 35, 36, 38 and 39 including the step of recording said stereo enhanced left and right output signals on a record medium.

50. The sound perspective correction system of any one of claims 28, 29, 30, 31 and 32 including first and second sound reproducing means connected to respectively receive said processed left and right signals.

51. The sound perspective correction system of any one of claims 28, 29, 30, 31 and 32 including means responsive to said means for selectively combining said processed sum and difference signals for recording said processed left and right signals.

52. A system for enhancing left and right stereo signals provided from a source of stereo sound comprising:

stereo image enhancement circuit means for processing the left and right input signals to provide a sum signal and processed sum and difference signals, stereo sensing means responsive to left and right stereo signals from said source of stereo sound and to said processed difference signal for sensing the amount of stereo in said stereo signals, first control means responsive to said stereo sensing means for generating a dynamic control signal representing such amount of stereo, second control means responsive to said control signal for modifying one of said processed signals in accordance with the amount of stereo in said stereo signals to decrease variation of a predetermined relation of the amplitudes of said sum signal and said processed difference signal, and means for combining said processed signals to provide left and right output signals.

53. The system of claim 52 wherein said stereo sensing means comprises means responsive to said left and right stereo signals for providing sum and difference signals respectively representing the sum of said left and right input signals and the difference of said left and right input signals, and wherein said first control means includes means responsive to said sum signal and said processed difference signal for generating said dynamic control signal.

54. The system of claim 52 wherein said stereo image enhancement circuit means includes sum and difference circuit means responsive to said left and right stereo signals respectively for generating sum and difference signals respectively representative of the sum and difference of said left and right stereo signals, means for processing said sum and difference signals to provide said processed sum and difference signals, said second control means comprising means for modifying said processed difference signal in a sense to decrease variation of the amplitude ratio of the modified processed difference signal to said sum signal.

55. The system of claim 52 wherein said stereo image enhancement circuit means comprises circuit means responsive to said left and right stereo signals for generating sum and difference signals respectively representing the sum and difference of said stereo signals, difference signal equalizer means responsive to said difference signal for selectively altering components in different frequency bands of said difference signal to provide said processed difference signal, and sum equalizer means responsive to said sum signal for selectively altering components of said sum signal in different frequency bands to provide said processed sum signal.

56. The system of claim 54 wherein said means for modifying said processed difference signal comprises means for maintaining a substantially constant ratio of magnitude of said sum signal to magnitude of said modified processed difference signal.

57. The sytem of claim 52 wherein said first control means includes means for clamping said control signal to a predetermined magnitude in response to a sensed amount of stereo in said stereo signals below a predetermined amount.

58. The system of claim 53 including means for feeding to said second control means a signal representing said one processed stereo signal as modified by said first control means.

59. The system of claim 52 including means for transducing said left and right output signals into left and right sound signals.

60. The system of claim 52 including the step of recording said left and right output signals.

61. A method for enhancing left and right stereo input signals provided from a source of stereo sound, said method comprising the steps of:

processing the left and right input signals to provide processed stereo signals as processed sum and difference signals, sensing the amount of stereo in said input signals by sensing said processed difference signal and generating a dynamic control signal representing such amount of stereo, employing said dynamic control signal to modify said processed difference signal in accordance with the amount of stereo in said input signals to provide a modified processed signal, and combining one of said processed stereo signals and combining one of said processed stereo signals and said modified processed signal to provide left and right output signals.

62. The method of claim 61 including the step of transducing said left and right output signals into left and right sound signals.

63. The method of claim 61 including the step of recording said left and right output signals.

64. The method of claim 61 wherein said step of sensing comprises the steps of providing sum and difference signals respectively representing the sum of said left and right input signals and the difference of said left and right input signals, and wherein said step of generating a dynamic control signal comprises generating said dynamic control signal as a function of a predetermined relation between magnitudes of said sum signal and said processed difference signal.

65. The method of claim 61 including the step of generating sum and difference signals respectively representing the sum and difference of said left and right stereo input signals, processing said sum and difference signals to provide said processed sum and difference signals, said step of employing said dynamic control signal comprising modifying said processed difference signal in a sense to decrease variation of a predetermined relation between magnitudes of said processed difference signal and said sum signal.

66. The method of claim 61 wherein said step of processing the left and right input signals comprises generating sum and difference signals respectively representing the sum and difference of said left and right input signals, selectively altering components in different frequency bands of said difference signal to provide a processed difference signal, and selectively altering components of said sum signal in said different frequency bands to provide a processed sum signal, said processed difference signal and processed sum signals forming said processed stereo signals.

67. The method of claim 61 wherein said step of processing the left and right input signals comprises generating sum and difference signals as the sum and difference respectively of said left and right input signals, selectively attenuating said sum signal within predetermined frequency bands and combining said attenuated sum signal and said difference signal to provide said left and right output signals.

68. The method of claim 61 wherein said step of processing the left and right input signals comprises generating sum and difference signals as the sum and difference respectively of said left and right input signals, selectively boosting said difference signal within predetermined frequency bands and combining said sum and said boosted difference signal to provide said left and right output signals.

69. The method of claim 61 wherein said step of processing the left and right input signals comprises generating sum and difference signals respectively representative of the sum and difference of said left and right stereo input signals, and processing said sum and difference signals to provide said processed sum and difference signals and wherein said step of employing said dynamic control signal comprises modifying said processed difference signal in a sense to maintain a constant ratio of amplitude of said processed difference signal to amplitude of said sum signal.

70. Apparatus for making a stereo enhanced sound recording from left and right stereo source signals comprising a. means for electronically adding said left and right signals to generate sum and difference signals;
b. means for creating a processed sum signal by selectively altering the relative amplitudes of components of said sum signal within respective predetermined frequency bands so as to enhance those of said sum signal components which are within frequency bands of highest difference signal component amplitudes relative to those of said sum signal components which are within frequency bands of lowest difference signal component amplitudes;
c. means for creating a processed difference signal by selectively altering the relative amplitudes of components of said difference signal within said predetermined frequency bands so as to deemphasize those of said difference signal components which are within frequency bands wherein said difference signal components are highest relative to those of said difference signal components which are within frequency bands wherein said difference signal components are the lowest;
d. means for combining said left and right signals with said processed difference signal, and with said processed sum signal to provide stereo enhanced left and right output signals;
e. a sound recording device connected to receive said stereo enhanced left and right output signals; and
f. means for operating said sound recording device to make a sound recording.

71. The apparatus of claim 70 wherein said means for creating processed sum and difference signals comprises means for electronically analyzing the frequency spectrum of said difference signal and for generating a set of control signals as a function of the amplitudes of said difference signal within said respective predetermined frequency bands, and means for utilizing said control signals to control the extent to which the amplitudes of components of said sum and difference signals are altered within said respective frequency bands.

72. The apparatus of claim 70 including means for continually and automatically amplifying one of said processed sum and difference signals as a function of its magnitude relative to that of one of said sum and difference signals so as to maintain a substantially consistent stereo separation between said left and right signals for differing amounts of stereo information within said left and right stereo source signals.

73. The apparatus of claim 72 wherein said means for continually and automatically amplifying one of said processed sum and difference signals includes means for maintaining a constant ratio between said processed difference signal and said sum signal.

74. The apparatus of claim 70 including means for selectively boosting components of said sum signal, and means for selectively attenuating components of said difference signal within selected ones of said predetermined frequency bands in order to prevent inappropriate boosting of artificial reverberation information in said difference signal.

75. The apparatus of claim 72 wherein said means for continually and automatically amplifying includes means for averaging the sum of (a) the inverted peak envelope of said sum signal, and (b) the non-inverted peak envelope of said difference signal so as to generate a reverberation control signal, and means for boosting and attenuating components of said sum and difference signals, respectively, as a function of said reverberation control signal.

76. The apparatus of claim 70 wherein said means for combining left and right signals with said processed difference signal and with said processed sum signal combines said signals in accordance with the equations:

$$L_{out}=L_{in}+K_1(L+R)_p+K_2(L-R)_p,$$

and $$R_{out}=R_{in}+K_1(L+R)_p+K_2(L-R)_p,$$

where $L_{out}$=stereo enhanced left output signal,
$R_{out}$=stereo enhanced right output signal,
$(L+R)_p$=processed sum signal,
$(L-R)_p$=processed difference signal,
$L_{in}$=left signal, $R_{in}$=right signal,
$K_1$=first independent variable, and
$K_2$=second independent variable.

77. Apparatus for making a stereo sound recording from left and right stereo source signals comprising:

a. means for electronically combining said left and right signals so as to generate sum and difference signals;
b. means for creating a processed sum signal;
c. means for creating a processed difference signal by selectively altering relative amplitudes of components of said difference signal so as to boost difference signal components in frequency bands that include relatively quiet components relative to difference signal components in frequency bands that include relatively loud components;
d. means for combining said left and right signals with said processed different signal, and with said processed sum signal to provide stereo enhanced left and right output signals;
e. a sound recording device connected to receive said left and right output signals; and
f. means for operating said sound recording device to make a sound recording.

78. Apparatus for making a stereo sound recording, corrected for perspective, from left and right stereo source signals comprising:

means for electronically adding left and right signals to provide sum and difference signals,
means for equalizing said sum signal within predetermined frequency bands to provide a processed sum signal, said means for equalizing comprising means for selectively attenuating said sum signal within said predetermined frequency bands by amounts corresponding to the average response of the human ear to front sounds diminished by the average response of the human ear to side sounds,
means for combining said selectively attenuated sum signal with said difference signal to provide left and right perspective corrected output signals,
recording means for making a stereo sound recording connected to receive said left and right perspective corrected output signals, and
means for operating said recording means to make a stereo sound recording.

79. Apparatus for making a stereo sound recording, corrected for perspective, from left and right stereo source signals comprising:

means for electronically adding left and right signals to provide sum and difference signals,
means for equalizing said difference signal within predetermined frequency bands to provide a processed difference signal, said means for equalizing comprising means for selectively boosting said difference signal within said predetermined frequency bands by amounts corresponding to the average response of the human ear to side sounds diminished by the average response of the human ear to front sounds,
means for combining said selectively boosted difference signal with said sum signal to provide left and right perspective corrected output signals,
recording means for making a stereo sound recording connected to receive said left and right perspective corrected output signals, and
means for operating said recording means to make a stereo sound recording.

80. A method of making a stereo enhanced sound recording from left and right stereo source signals comprising the steps of a. electronically combining said left and right signals to generate sum and difference signals,
b. creating a processed sum signal by selectively altering the relative amplitudes of components of said sum signal within respective predetermined frequency bands so as to enhance those of said sum signal components which are within frequency bands of highest difference signal component amplitudes relative to those of said sum signal components which are within frequency bands of lowest difference signal component amplitudes;
c. creating a processed difference signal by selectively altering the relative amplitudes of components of said difference signal within said predetermined frequency bands so as to deemphasize those of said difference signal components which are within frequency bands wherein said difference signal components are highest relative to those of said difference signal components which are within frequency bands wherein said difference signal components are the lowest;
d. combining said left and right signals with said processed difference signal, and with said processed sum signal to provide stereo enhanced left and right output signals;
e. feeding said stereo enhanced left and right output signals to a sound recording device; and
f. operating said sound recording device to make a sound recording.

81. The method of claim 80 wherein said steps of creating processed sum and difference signals are augmented by the step of electronically analyzing the frequency spectrum of said difference signal and generating a set of control signals as a function of the amplitudes of said difference signal within said respective predetermined frequency bands, and utilizing said control signals to determine the extent to which the amplitudes of components of said sum and difference signals are altered within said respective frequency bands.

82. The method of claim 80 additionally including the additional step of continually and automatically amplifying said processed difference signal as a function of its magnitude relative to that of said sum signal so as to maintain a substantially consistent stereo separation between said left and right signals for differing amounts of stereo information within said left and right stereo source signals.

83. The method of claim 82 wherein said step of continually and automatically amplifying said processed difference signal is performed so as to maintain a constant ratio between said processed difference signal and said sum signal.

84. The method of claim 80 including the additional step of selectively boosting components of said sum signal and selectively attenuating components of said difference signal within selected ones of said predetermined frequency bands in order to prevent inappropriate boosting of artificial reverberation information in said difference signal.

85. The method of claim 82 wherein said step of continually and automatically amplifying is accomplished by averaging the sum of (a) the inverted peak envelope of said sum signal, and (b) the non-inverted peak envelope of said difference signal so as to generate a reverberation control signal, and boosting and attenuating components of said sum and difference signals, respectively, as a function of said reverberation control signal.

86. The method of claim 80 wherein the step of combining said left and right signals with said processed difference signal and with said processed sum signal is in accordance with the equations:

$$L_{out}=L_{in}+K_1(L+R)_p+K_2(L-R)_p,$$

and $$R_{out}=R_{in}+K_1(L+R)_p+K_2(L-R)_p,$$

where $L_{out}$=stereo enhanced left output signal,
$R_{out}$=stereo enhanced right output signal,
$(L+R)_p$=processed sum signal,
$(L-R)_p$=processed difference signal,
$L_{in}$=left signal,
$R_{in}$=right signal,
$K_1$=first independent variable, and
$K_2$=second independent variable.

87. A method for making a stereo sound recording from left and right stereo source signals comprising the steps of:

a. electronically combining said left and right signals so as to generate sum and difference signals;
b. creating a processed sum signal;
c. creating a processed difference signal by selectively altering the relative amplitudes of components of said difference signal so as to boost difference signal components in quiet frequency bands that include relatively quiet components relative to difference signal components in frequency bands that include relatively loud components;
d. combining said left and right signals with said processed difference signal, and with said processed sum signal to provide stereo enhanced left and right output signals;
e. feeding said stereo enhanced left and right output signals to a sound recording device; and
f. operating said sound recording device to make a sound recording.

88. The method of claim 87 wherein said step of creating a processed sum signal includes the steps of:

filtering said sum signal so as to attenuate components outside a predetermined frequency range which statistically includes relatively loud difference signal components and amplifying the filtered sum signal.

89. The method of claim 87 wherein said step of creating a processed difference signal includes the step of:

selectively attenuating difference signal components so as to attenuate frequencies that statistically include louder components more than frequencies that statistically include quieter components, and amplifying the selectively attenuated difference signal components so as to boost selected difference signal components relative to other difference signal components.

90. A method of making a stereo sound recording, corrected for perspective, from left and right stereo source signals comprising the steps of:

electronically combining left and right stereo source signals to provide sum and difference signals,
equalizing said sum signal within predetermined frequency bands to provide a processed sum signal, said equalizing comprising the steps of selectively attenuating said sum signal within said predetermined frequency bands by amounts corresponding to the average response of the human ear to front sounds diminished by the average response of the human ear to side sounds,
combining said selectively attenuated sum signal with said difference signal to provide left and right perspective corrected output signals,
feeding said left and right perspective corrected output signals to an apparatus for making a stereo sound recording, and
operating said apparatus to make a stereo sound recording.

91. A method of making a stereo sound recording, corrected for perspective, from left and right stereo source signals comprising the steps of:

electronically combining left and right signals to provide sum and difference signals;
equalizing said difference signal within predetermined frequency bands to provide a processed difference signal, said step of equalizing comprising the step of selectively boosting said difference signal within said predetermined frequency bands by amounts corresponding to the average response of the human ear to side sounds diminished by the average response of the human ear to front sounds,
combining said selectively boosted difference signal with said sum signal to provide left and right perspective corrected output signals,
feeding said left and right perspective corrected output signals to an apparatus for making a stereo sound recording, and
operating said apparatus to make a stereo sound recording.

92. A stereo enhanced sound recording made by the method of any one of claims 80 through 91, inclusive.

93. An enhanced image stereo sound recording for use in a sound recording playback system, said sound recording comprising:

a record medium embodying signal producing means adapted to operate with a sound recording responsive device to produce left and right stereo output signals that are modifications of left and right stereo source signals, said stereo output signals each comprising a combination of signal components including:
(1) a processed difference signal which comprises a modification of an input difference signal representing the difference of said left and right stereo source signals,
(2) a processed sum signal which comprises a modification of an input sum signal representing the sum of said left and right stereo source signals,
(3) said processed difference signal and said input sum signal having a predetermined relation of magnitudes that is substantially constant.

94. The sound recording of claim 93 wherein said processed difference signal includes components of said input difference signal boosted in quieter frequency bands wherein input difference signal amplitudes are relatively lower relative to components in louder frequency bands wherein input difference signal amplitudes are relatively higher, and wherein said processed sum signal includes components of said input sum signal that are boosted in said louder frequency bands relative to input sum signal components in said quieter frequency bands.

95. In a stereo sound system having stereo output signals comprising a combination of signal components including processed sum and difference signals representing respectively the sum and difference of left and right stereo source signals, a method of enhancing the stereo output signals comprising the steps of:

sensing the processed difference signal, generating a control signal representing a predetermined relation of the magnitudes of (a) the sensed processed difference signal and (b) a sum signal indicative of the sum of said left and right stereo source signals, and modifying said processed difference signal in accordance with said control signal.

96. The method of claim 95 wherein said step of modifying comprises modifying said processed difference signal so as to decrease variation of the ratio of magnitudes of said sum signal and said processed difference signal.

97. A stereo sound recording for use with a stereo player that is used in conjunction with a pair of speakers to cause the speakers to produce enhanced stereo sound, said sound recording comprising a record medium having signal producing means adapted to act on a sound recording responsive device of a stereo player to cause said sound recording responsive device to produce left and right stereo signal outputs that are modifications of left and right stereo source signals, (a) said left signal stereo output having 1. a left stereo source signal component,
2. a processed difference signal component that comprises an input difference signal representing the difference between left and right stereo source signals modified to boost input difference signal components in quieter frequency bands wherein input difference signal amplitudes are relatively low, relative to input difference signal components in louder frequency bands wherein input difference signal amplitudes are relatively high, and
3. a processed sum signal component that comprises an input sum signal representing the sum of left and right stereo source signals modified to boost input sum signal components in said louder frequency bands relative to input sum signal components in said quieter frequency bands, (b) said right stereo signal output having 1. a right stereo source signal component,
2. a processed difference signal component that comprises an input difference signal representing the difference between left and right stereo source signals modified to boost input difference signal components in quieter frequency bands wherein input difference signal amplitudes are relatively low, relative to input difference signal components in louder frequency bands wherein input difference signal amplitudes are relatively high, and
3. a processed sum signal component that comprises an input sum signal representing the sum of left and right stereo source signals modified to boost input sum signal components in said louder frequency bands relative to input sum signal components in said quieter frequency bands.

98. The stereo sound recording of claim 97 wherein the ratio of amplitudes of one of said input sum and difference signals to one of said processed sum and difference signal components is substantially constant.

99. The sound recording of claim 97 wherein one of said processed sum and difference signal components has an amplitude that varies in accordance with one of said input sum and difference signals to continually adjust the amount of processing of said one processed signal automatically according to the amount of stereo information present in said stereo source signals.

100. The stereo recording of claim 97 wherein said processed difference signal component has a value that varies with variation of the ratio between said input sum signal and said processed difference signal component.

101. The stereo sound recording of claim 97 wherein said input sum signal and said input difference signal have components thereof in selected frequency bands altered to compensate for effects of artificial reverberation.

102. The stereo sound recording of claim 97 wherein said input sum signal and said input difference signal have amplitudes of components thereof within predetermined reverberation frequency bands boosted and attenuated as a function of the average of the sum of (a) the inverted peak envelope of the sum signal, and (b) the noninverted peak envelope of the difference signal.

103. The stereo sound recording of claim 97 wherein said input difference signal is further modified to additionally boost input difference signal components between 1 KHz and 4 KHz.

104. The stereo sound recording of claim 97 wherein said left stereo signal output comprises the sum of said left stereo source signal component, said processed difference signal component and said processed sum signal component, and wherein said right stereo output signal comprises the difference between (a) said processed difference component signal and (b) the sum of said right stereo source component with said processed sum signal component.

105. A stereo sound recording adapted to generate signal responses in a stereo player that is used in conjunction with a pair of speakers to cause the speakers to produce enhanced stereo sound, said sound recording comprising:

a record medium having signal producing means adapted to act on a sound recording responsive device of a stereo player to cause the sound recording responsive device to produce left and right stereo output signals that are modifications of left and right stereo source signals and that are comprised of a combination of the following components:

(a) a perspective sum signal component representing the sum of left and right stereo source signals, and (b) a perspective difference signal component representing the difference between left and right stereo source signals, said perspective sum signal component having subcomponents thereof attenuated by amounts corresponding to the statistical average of response of the human ear to front sounds diminished by the statistical average response of the human ear to side sounds.

106. The stereo sound recording of claim 105 wherein said sub-components are in frequency bands centered at about 500 Hz, 1 KHz and 8 KHz and said sum signal components are attenuated respectively by about 5, 7.5 and 15 dB.

107. A stereo sound recording adapted to generate signal responses in a stereo player that is used in conjunction with a pair of speakers to cause the speakers to produce enhanced stereo sound, said sound recording comprising:

a record medium having signal producing means adapted to act on a sound recording responsive device of a stereo player to cause the sound recording responsive device to produce left and right stereo output signals that are modifications of left and right stereo source signals and that are composed of a combination of the following components:

(a) a perspective sum signal component representing the sum of left and right stereo source signals, and (b) a perspective difference signal component representing the difference between left and right stereo source signals, said perspective difference signal component having sub-components boosted by amounts corresponding to the statistical average of response of the human ear to side sounds diminished by the statistical average of response of the human ear to front sounds.

108. The stereo sound recording of claim 107 wherein said sub-components are centered at about 500 Hz, 1 KHz and 8 KHz.

109. An enhanced image stereo sound recording for use in a sound recording playback system, said recording comprising a record medium having signal producing means adapted to cooperate with a sound recording reponsive device to produce left and right stereo output signals that are modifications of left and right stereo source signals, said stereo output signals each comprising a combination of signal components including:

1. a processed difference signal which comprises a modification of an input difference signal representing the difference of said left and right stereo source signals and having the relative amplitude of components of such input difference signal modified to boost components of such input difference signal that are within frequency bands wherein the input difference signal has lowest amplitude relative to those components of such input difference signal that are within frequency bands wherein the input difference signal components have highest amplitude, and 2. a processed sum signal which comprises a modification of an input sum signal representing the sum of said left and right input signals and having the relative amplitudes of components of such input sum signal modified to boost components of said input sum signal in frequency bands of higher amplitude components of the input difference signal relative to components of said input sum signal in frequency bands of lower amplitude components of the input difference signal.

110. The enhanced image stereo sound recording of claim 109 wherein the ratio of the magnitude of one of said sum and difference signals to the magnitude of one of said processed sum and difference signals is substantially constant.

111. The enhanced image stereo sound recording of claim 109 wherein a predetermined substantially constant relation of amplitudes exists between one of said processed sum and difference signals and one of said input sum and difference signals.

112. The stereo image enhancement system of claim 1 including means for generating a reverberation control signal indicative of the amount of reverberation in said left and right signals, and means responsive to said reverberation control signal for controlling the amount of reverberation in said output signals.

113. The stereo image enhancement system of claim 112 wherein said last mentioned means comprises means responsive to the reverberation control signal for boosting the processed sum signal in accordance with reverberation in said left and right signals and for attenuating said processed difference signal in accordance with reverberation in said left and right signals.

114. The stereo image enhancement system of claim 112 wherein said last mentioned means comprises means for attenuating said processed difference signal in accordance with the amount of reverberation in said left and right signals.

115. The stereo image enhancement system of claim 112 wherein said last mentioned means comprises means responsive to said reverberation control signal for boosting said processed sum signal in accordance with the amount of reverberation in said left and right signals.

116. The stereo image enhancement system of claim 115 wherein said means for boosting comprises a gain controlled amplifier having said processed sum signal as an input thereto and having a gain control input receiving said reverberation control signal.

117. The stereo image enhancement system of any one of claims 112, 113, and 116 including manual means for controlling amplitude of said reverberation control signal.

118. The stereo image enhancement system of claim 52 including means for generating a reverberation control signal indicative of the amount of reverberation in said left and right stereo signals, and means responsive to said reverberation control signal for controlling the amount of reverberation in said output signals.

119. The system of any one of claims 54, 55 and 56 including means for generating a reverberation control signal indicative of the amount of reverberation in said left and right stereo signals, and means responsive to said reverberation control signal for boosting said processed sum signal and attenuating said processed difference signal in accordance with the amount of reverberation in said left and right stereo signals.

120. The method of claim 61 or 66 wherein said left and right output signals provide enhanced stereo output including enhanced reverberation components and including the steps of sensing the amount of reverberation in said left and right stereo input signals and generating a reverberation control signal indicative of sensed reverberation, and employing the reverberation control signal to modify the processed stereo signals so as to decrease the amount of enhanced reverberation in said left and right output signals.

121. The apparatus of claim 70 including means for generating a reverberation control signal indicative of the amount of reverberation in said left and right stereo source signals, and means responsive to said reverberation control signal for controlling the amount of reverberation in said stereo enhanced left and right output signals.

122. The method of claim 80 including the step of generating a reverberation control signal indicative of the amount of reverberation in said left and right stereo source signals, and employing said reverberation control signal to modify said processed sum and processed difference signals to control the amount of reverberation in said stereo enhanced left and right output signals.

123. The method of claim 84 wherein said step of selectively boosting components of said sum signal comprises the steps of generating a reverberation control signal indicative of the amount of reverberation in said left and right stereo source signals and amplifying said sum signal in accordance with said reverberation control signal.

124. The method of claim 123 including the step of manually varying the magnitude of said reverberation control signal to thereby provide both automatic and manual control of the amount of reverberation in said stereo enhanced left and right output signals.

125. A system for enhancing left and right input signals provided from a source of stereo sound comprising stereo image enhancement circuit means for processing the left and right input signals to provide left and right enhanced stereo signals, reverberation sensing means responsive to the left and right input signals for generating a reverberation control signal indicative of the amount of reverberation in said left and right input signals, and means responsive to said reverberation control signal for decreasing the amount of enhancement in said left and right enhanced stereo output signals in accordance with the amount of reverberation in said left and right stereo input signals.

126. The system of claim 125 wherein said stereo image enhancement circuit means comprises circuit means responsive to said left and right input signals for generating sum and difference signals respectively representing the sum and difference of said input signals, difference equalizer means responsive to said difference signal for selectively altering components in different frequency bands of said difference signal to provide said enhanced difference signal, and sum equalizer means responsive to said sum signal for selectively altering components of said sum signal in different frequency bands to provide said enhanced sum signal, and wherein said means responsive to said reverberation control signal comprises means for attenuating said enhanced difference signal in accordance with said reverberation control signal and means for boosting said enhansed sum signal in accordance with said reverberation control signal.

127. A stereo enhanced sound recording made by the method of any one of claims 123 or 124.

128. The stereo sound recording of claim 97 wherein said processed difference signal component of both said left and right stereo signal outputs includes a band of frequencies having an amplitude that is attenuated in accordance with the amount of reverberation in the left and right stereo source signals, and wherein the processed sum signal components of both said left and right stereo signal outputs is boosted in accordance with the amount of reverberation in said left and right stereo source signals.

129. A system for enhancing left and right stereo signals provided from a source of stereo sound comprising:

(a) stereo enhancement circuit means for processing the left and right stereo signals to provide processed stereo signals as processed sum and difference signals, (b) closed loop feedback means for modifying one of said processed signals in accordance with the amount of stereo in said stereo signals, said feedback means comprising:

(1) first control means responsive to said one processed signal for generating a dynamic control signal representing the amount of stereo in said stereo signals, and (2) second control means responsive to said control signal for modifying said one processed signal, and (c) means for combining said one processed signal and the unmodified processed signal to provide left and right output signals.

130. The system of claim 129 wherein said enhancement circuit means includes means responsive to both of said stereo signals to provide sum and difference signals, and wherein said first control means includes means for combining said sum signal with said processed difference signal to generate said dynamic control signal, said one processed signal comprising said processed difference signal.

131. A system for correcting perspective of left and right stereo source signals comprising:

means for electronically combining the left and right signals from the stereo source to provide sum and difference signals, means for equalizing said difference signal within predetermined frequency bands to provide a processed difference signal, said means for equalizing comprising means for selectively boosting said difference signal by amounts corresponding to the average response of the human ear to side sounds diminished by the average response of the human ear to front sounds, and means for combining said selectively boosted difference signal with said sum signal to provide left and right perspective corrected output signals.

132. A system for correcting perspective of left and right source signals comprising:

means for electronically adding the left and right stereo source signal to provide sum and difference signals, means for equalizing said sum signal within predetermined frequency bands to provide a processed sum signal, said means for equalizing comprising means for selectively attenuating said sum signal by amounts corresponding to the average response of the human ear to front sounds diminished by the average response of the human ear to side sounds, and means for combining said selectively attenuated sum signal with said difference signal to provide left and right perspective corrected output signal.

133. A system for enhancing left and right stereo signals provided from a source of stereo sound comprising:

stereo image enhancement circuit means for processing the left and right stereo signals to provide processed stereo signals, stereo sensing means responsive to left and right stereo signals from said source of stereo sound for sensing the amount of stereo in said stereo signals, first control means responsive to said stereo sensing means for generating a dynamic control signal representing said amount of stereo, second control means responsive to said control signal for modifying one of said processed stereo signals in accordance with the amount of stereo in said stereo signals, and means for combining said modified one of said processed stereo signals and the unmodified processed stereo signal to provide left and right output signals, said stereo image enhancement circuit means including sum and difference circuit means responsive to said left and right stereo signals respectively for generating sum and difference signals respectively representative of the sum and difference of said left and right stereo signals, means for processing said sum and difference signals to provide processed sum and difference signals which form said processed stereo signals, said second control means comprising means for modifying one of said processed sum and difference signals in a sense to decrease variation of a selected relation between said one of said processed sum and difference signals, and one of said sum and difference signals, and including means for generating a reverberation control signal indicative of the amount of reverberation in said left and right stereo signals, and means responsive to said reverberation control signal for boosting said processed sum signal and attenuating said processed difference signal in accordance with the amount of reverberation in said left and right stereo signals.

134. A system for enhancing left and right stereo input signals provided from a source of stereo sound comprising:

stereo image enhancement circuit means for processing the left and right input signals to provide processed stereo signals, stereo sensing means responsive to left and right stereo input signals from said source of stereo sound for sensing the amount of stereo in said input signals, first control means responsive to said stereo sensing means for generating a dynamic control signal representing said amount of stereo, second control means responsive to said control signal for modifying one of said processed stereo signals in accordance with the amount of stereo in said input signals, and means for combining said modified one of said processed stereo signals and the unmodified processed stereo signal to provide left and right output signals, said stereo image enhancement circuit means comprising circuit means responsive to said left and right stereo input signals for generating sum and difference signals respectively representing the sum and difference signals respectively representing the sum and difference of said stereo input signals, difference signal equalizer means responsive to said difference signal for selectively altering components in different frequency bands of said difference signal to provide a processed difference signal, and sum equalizer means responsive to said sum signal for selectively altering components of said sum signal in different frequency bands to provide a processed sum signal, said processed sum and difference signals forming said processed stereo signals, and including means for generating a reverberation control signal indicative of the amount of reverberation in said left and right stereo input signals, and means responsive to said reverberation control signal for boosting said processed sum signal and attenuating said processed difference signal in accordance with the amount of reverberation in said left and right stereo input signals.

135. A system for enhancing left and right stereo input signals provided from a source of stereo sound comprising:

stereo image enhancement circuit means for processing the left and right input signals to provide processed stereo signals, stereo sensing means responsive to left and right stereo input signals from said source of stereo sound for sensing the amount of stereo in said input signals, first control means responsive to said stereo sensing means for generating a dynamic control signal representing said amount of stereo, second control means responsive to said control signal for modifying one of said processed stereo signals in accordance with the amount of stereo in said input signals, and means for combining said modified one of suit processed stereo signals and the unmodified processed stereo signal to provide left and right output signals, said stereo image enhancement circuit means including sum and difference circuit means responsive to said left and right stereo input signals respectively for generating sum and difference signals respectively representative of the sum and difference of said left and right stereo input signals, means for processing said sum and difference signals to provide processed sum and difference signals which form said processed stereo signals, said second control means comprising means for modifying one of said processed sum and difference signals in a sense to decrease variation of a selected relation between said one of said processed sum and difference signals, and one of said sum and difference signals, said means for modifying one of said processed sum and difference signals comprising means for maintaining a substantially constant ratio between said sum signal and said processed difference signal, and including means for generating a reverberation control signal indicative of the amount of reverberation in said left and right stereo signals, and means responsive to said reverberation control signal for boosting said processed sum signal and attenuating said processed difference signal in accordance with the amount of reverberation in said left and right stereo signals.

136. A method for enhancing left and right stereo input signals provided from a source of stereo sound, said method comprising the steps of:

processing the left and right input signals, sensing the amount of stereo in said input signals and generating a dynamic control signal representing said amount of stereo, employing said dynamic control signal to modify one of said processed stereo signals signal in accordance with the amount of stereo in said input signals to provide a modified processed signal, and combining one of said processed stereo signals and said modified processed stereo signal to provide left and right output signals, said left and right output signals providing enhanced stereo output including enhanced reverberation components, and including the steps of sensing the amount of reverberation in said left and right stereo input signals and generating a reverberation control signal indicative of sensed reverberation, and employing the reverberation control signal to modify the processed stereo signals so as to decrease the amount of enhanced reverberation in said left and right output signals.

137. A method for enhancing left and right stereo input signals provided from a source of stereo sound, said method comprising the steps of:

processing the left and right input signals, sensing the amount of stereo in said input signals and generating a dynamic control signal representing said amount of stereo, employing said dynamic control signal to modify one of said processed stereo signals signal in accordance with the amount of stereo in said input signals to provide a modified processed signal, and combining one of said processed stereo signals and said modified processed stereo signal to provide left and right output signals, said step of processing the left and right input signals comprising generating sum and difference signals respectively representing the sum and difference of said left and right input signals, selectively altering components in different frequency bands of said difference signal to provide a processed difference signal, and selectively altering components of said sum signal in said difference frequency bands to provide a processed sum signal, said processed difference signal and processed sum signals forming said processed stereo signals, said left and right output signals providing enhanced stereo output including enhanced reverberation components, and including the steps of sensing the amount of reverberation in said left and right stereo input signals and generating a reverberation control signal indicative of sensed reverberation, and employing the reverberation control signal to modify the processed stereo signals so as to decrease the amount of enhanced reverberation in said left and right output signals.

138. A stereo sound system having respective left and right input signals, comprising:

means for providing the sum of the left and right signals as a sum signal and providing the difference between the left and right signals as a difference signal, first means for processing said sum signal to provide a processed sum signal, second means for processing said difference signal to provide a processed difference signal, means for generating a reverberation control signal comprising means for averaging the difference of the difference and sum signals to generate said reverberation control signal, and means for boosting and attenuating components of said processed sum and difference signals respectively as a function of said reverberation control signal.

139. The system of claim 138 wherein said means for averaging comprises means for deriving the inverted peak envelope of the sum signal, means for deriving the non-inverted peak envelope of the difference signal, and means for combining said peak envelopes to generate said reverberation control signal.

140. In a stereo enhancement system having sum and difference signals derived from left and right stereo signals, an improved enhancement system comprising:

stereo image enhancement circuit means for processing at least some of said signals to provide processed stereo signals including at least a processed difference signal, stereo sensing means responsive to said processed difference signal for sensing the amount of stereo in said left and right stereo signals and providing a feedback signal, control means responsive to the feedback signal of said stereo sensing means for modifying said processed difference signal in accordance with the amount of stereo in said left and right stereo signals, and means for combining said processed difference signal and at least another of said signals to provide left and right output signals.

141. The system of claim 140 wherein said control means includes means responsive to said sum signal and said feedback signal for maintaining a predetermined relation between magnitudes of said sum and processed difference signals.

142. The system of claim 141 wherein said control means comprises means for maintaining a substantially constant ratio of magnitudes of said sum signal and said processed difference signal.

143. A system for enhancing left and right stereo signals providing from a source of stereo sound comprising:

stereo image enhancement means for providing at least a processed difference signal and a sum signal from said left and right signals, and closed loop feedback means responsive to said processed difference signal for controlling the processed difference signal to decrease variation of the ratio of magnitudes of said processed difference signal and said sum signal.

144. The system of claim 143 wherein said feedback means comprises means for generating a feedback signal indicative of magnitude of said processed difference signal, and means responsive to said feedback signal and a second signal indicative of magnitude of said sum signal for modifying said processed difference signal.

145. A stereo enhancement system having sum and difference signals derived from left and right stereo signals, comprising:

processing means responsive to said sum and difference signals for selectively altering the relative amplitudes of components of said difference signal so as to boost lower and higher frequency difference signal components relative to other difference signal components to provide a processed difference signal, and for selectively altering the relative amplitudes of components of said sum signal so as to boost selected sum signal components relative to other sum signal components to provide a processed sum signal, and means responsive to said processed sum and difference signals to provide left and right stereo output signals.

146. The stereo enhancement system of claim 145 wherein said processing means comprises:

first equalizing means for selectively attenuating difference signal components so as to attenuate frequencies that statistically include louder components more than frequencies that statistically include quieter components, second equalizing means for relatively boosting sum signal components within a predetermined frequency range which statistically includes said louder difference signal components, and for relatively attenuating sum signal components outside said predetermined frequency range.

147. The stereo enhancement system of claim 145 including control means for amplifying said processed difference signal as a function of its magnitude relative to that of said sum signal to provide a substantially consistent stereo image for differing amounts of stereo information contained in said left and right stereo signals.

148. The stereo enhancement system of claim 145 including means for monitoring the relative magnitudes of said sum and difference signals to detect conditions indicative of the presence of artificial reverberation, and for modifying said processed difference signal to compensate for effects of artificial reverberation.

149. Apparatus for making a stereo sound recording from left and right stereo source signals, comprising:

means for providing the sum of the left and right signals as a sum signal and providing the difference between the left and right signals as a difference signal, means responsive to said left and right stereo source signals for generating a reverberation control signal indicative of the amount of reverberation in said left and right signals, means responsive to at least some of said signals for providing left and right stereo output signals, and control means responsive to said reverberation control signal for varying amplitudes of selected components of at least said difference signals to control the amount of reverberation in said stereo output signals.

150. The apparatus of claim 149 wherein said control means comprises means for attenuating components of said difference signal in frequencies between about two hundred fifty to twenty-five hundred Hertz.

151. The apparatus of claim 149 wherein said means responsive to said stereo source signals comprises circuit means responsive to said sum and difference signals for generating said reverberation control signal as a signal indicative of the difference between said difference and sum signals.

152. The apparatus of claim 149 wherein said means for generating a reverberation control signal comprises means for averaging the difference of said difference and sum signals, and wherein said means for varying comprises means for boosting and attenuating components of said sum and difference signals respectively.

153. The apparatus of claim 149 wherein said means for varying amplitudes comprises means for boosting said sum signal, and means for attenuating components of said difference signal by an amount less than the amount of boost of said sum signal.

154. The apparatus of claim 149 wherein said means for varying amplitudes comprises a gain controlled amplifier responsive to said reverberation control signal for boosting said sum signal and a filter for selectively attenuating components of said difference signal in accordance with said reverberation signal.

155. A method of making a stereo sound recording from left and right stereo source signals, comprising the steps of:

providing the sum of the left and right stereo source signals as a sum signal and providing the difference between the left and right stereo source signals as a difference signal, generating a reverberation control signal indicative of the amount of reverberation in said left and right stereo source signals, generating reverberation controlled stereo output signals from said sum and difference signals, employing said reverberation control signal to modify at least said difference signal as a function of said reverberation control signal to control the amount of reverberation in said stereo output signals, and operating a sound recording device in response to said reverberation controlled stereo output signals to make a sound recording.

156. The method of claim 155 wherein said step of employing said reverberation control signal comprises the step of boosting said sum signal in accordance with said control signal.

157. The method of claim 155 wherein said step of employing said reverberation control signal comprises attenuating said difference signal in a selected frequency band in accordance with said control signal.

158. The method of claim 155 wherein said step of generating a reverberation control signal comprises differentially combining said sum and difference signals, and wherein said step of employing said reverberation control signal comprises boosting said sum signal and attenuating selected components of said difference signal in accordance with the differentially combined sum and difference signals.

159. The method of claim 155 including the step of controlling the amount of reverberation in said stereo output signals by varying the magnitude of said reverberation control signal.

* * * * *

UNITED STATES PATENT AND TRADEMARK OFFICE

CERTIFICATE OF CORRECTION

PATENT NO. : 4,748,669

DATED : May 31, 1988

INVENTOR(S) : Arnold I. Klayman

It is certified that error appears in the above-identified patent and that said Letters Patent is hereby corrected as shown below:

After the "Title Page" insert -- Page 2 --, as part of Letters Patent 4,748,669, as shown on the attached sheet.

Signed and Sealed this

Thirteenth Day of December, 1988

*Attest:*

DONALD J. QUIGG

*Attesting Officer*

*Commissioner of Patents and Trademarks*

U.S. PATENT DOCUMENTS 4,562,487 12/1985 Hurst et al. .
4,567,607 1/1986 Bruney et al. .
4,599,611 7/1986 Bowker et al. .
4,683,496 7/1987 Tom .
4,149,031 4/1979 Cooper .
4,149,036 4/1979 Okamoto et al. .
4,152,542 1/1979 Cooper .
4,162,457 7/1979 Grodinsky .
4,185,239 1/1980 Filloux .
4,188,504 2/1980 Kasuga et al. .
4,192,969 3/1980 Iwahara .
4,204,092 5/1980 Bruney .
4,208,546 6/1980 Laupman .
4,209,665 6/1980 Iwahara .
4,214,267 7/1980 Roese .
4,218,585 8/1980 Carver .
4,219,696 8/1980 Kogure et al. .
4,239,937 12/1980 Kampmann .
4,239,939 12/1980 Griffis .
4,251,688 2/1981 Furner .
4,268,915 5/1981 Parmet .
4,303,800 12/1981 DeFreitas .
4,308,423 12/1981 Cohen .
4,308,426 12/1981 Kikuchi .
4,309,570 1/1982 Carver .
4,316,058 2/1982 Christensen .
4,329,544 2/1982 Yamada .
4,334,740 6/1982 Wray .
4,349,698 9/1982 Iwahara .
4,352,953 10/1982 Emmer .
4,355,203 10/1982 Cohen .
4,356,349 10/1982 Robinson ..... 381/1
4,388,494 6/1983 Schone et al. .
4,393,270 7/1983 Van den Berg .
4,394,536 9/1983 Shima et al. .
4,394,537 7/1983 Shima et al. .
4,446,488 5/1984 Suzuki .
4,489,432 12/1984 Polk ..... 381/24
4,495,637 1/1985 Bruney .
4,503,554 3/1985 Davis ..... 381/1
4,546,389 10/1985 Gibson et al. .
4,549,228 10/1985 Dieterich .
4,551,770 11/1985 Palmer et al. .
4,553,176 11/1985 Mendrala .

OTHER PUBLICATIONS

Entertainment Headsets," Gilman, J. Audio Eng. Soc., vol. 31, No. 12, pp. 914–920, Dec., 1983.
"The New Featherweight Headphones" Stock, Audio, pp. 30–32, May, 1981.
"The Acoustics of the Singing Voice," (1977) Sundberg, The Physics of Music, Scientific American Inc.
"The Loudspeaker/Living Room System," Allison, Audio, pp. 18–22, Nov., 1971.
"How We Hear Direction," Vaughan, *Audio*, pp. 50–55, Dec., 1983.
Sound and Hearing, Time, Inc., pp. 98–106, Reprinted 1971.

US004748669C1

(12) EX PARTE REEXAMINATION CERTIFICATE (5161st)

United States Patent
Klayman

(10) Number: US 4,748,669 C1
(45) Certificate Issued: Jul. 26, 2005

(54) STEREO ENHANCEMENT SYSTEM

(75) Inventor: Arnold I. Klayman, Huntington Beach, CA (US)

(73) Assignee: SRS Labs, Inc., Newport Beach, CA (US)

Reexamination Request:
No. 90/004,970, Apr. 20, 1998

Reexamination Certificate for:

| | |
|---|---|
| Patent No.: | **4,748,669** |
| Issued: | **May 31, 1988** |
| Appl. No.: | **06/929,452** |
| Filed: | **Nov. 12, 1986** |

Certificate of Correction issued Dec. 13, 1988.

Related U.S. Application Data

(63) Continuation-in-part of application No. 06/844,929, filed on Mar. 27, 1986, now abandoned.

(51) Int. Cl.[7] ..... H04R 5/00; H04S 1/00
(52) U.S. Cl. ..... 381/1; 381/66; 381/98; 381/309; 381/103; 369/86
(58) Field of Search ..... 381/1, 27, 309, 381/17, 18, 63, 66, 103, 106, 98; 369/5, 87, 86

(56) References Cited

U.S. PATENT DOCUMENTS 4,239,937 A 12/1980 Kampmann

OTHER PUBLICATIONS

Vaughan, Denis, "How We Hear Direction," *Audio*, pp. 50–55, Dec. 1983.
Gilman, Samuel, "Some Factors Affecting The Performance Of Airline Entertainment Headsets," *J. Audio Eng. Soc.* vol. 31, No. 12, pp. 914–920, Dec. 1983.
"The New Featherweight Headphones," *Audio*, pp. 30–32, May 1981.
Sundberg, Johan, "The Acoustics Of The Singing Voice," The Physics of Music, Scientific American Inc., Mar. 1977.
Allison, Roy F., "The Loudspeaker/Living Room System," *Audio*, pp. 18–22, Nov. 1971.
Stevens, S.S., et al., "Sound And Hearing," Time, Inc., pp. 98–106, reprinted 1971.
Kaufman, R.J., "Frequency Contouring for Image Enhancement", *Audio*, pp. 34–39 (1985).

*Primary Examiner*—Vivian Chang

(57) ABSTRACT

A stereo enhancement system (300) is disclosed which provides an enhanced wider stereo image and a wider listening area, and further provides perspective correction for achieving correct stereo sound perspective with speakers at different locations and with headphones. The stereo enhancement system includes a stereo image enhancement system (100, 10, 110) which includes circuitry (11, 13, 111, 113) for generating sum and difference signals based on left and right stereo signals, circuitry (17, 18, 19, 22, 30, 115, 125, 129, 40) for selectively altering the relative amplitudes of the difference signal components, circuitry (17, 21, 30, 117, 127, 40) for selectively altering the relative amplitudes of the sum signal components, and circuitry (23, 25, 27, 119, 121, 123) for combining the processed sum and difference signals with the original left and right stereo signals to produce enhanced left and right stereo signals. The enhancement system further includes a perspective correction system (200, 210) which is responsive to the enhanced left and right signals provided by the stereo image enhancement system or to left and right stereo signals of an audio system. The perspective correction system includes circuitry (211, 213) for generating sum and difference signals from the left and right stereo signals, equalization circuitry (215, 217, 221, 223) for providing fixed equalization for the sum and difference signals to compensate for the variation with direction of the frequency response of the human ear, and mixing circuitry (225) for combining the equalized sum and difference signals to produce left and right signals.

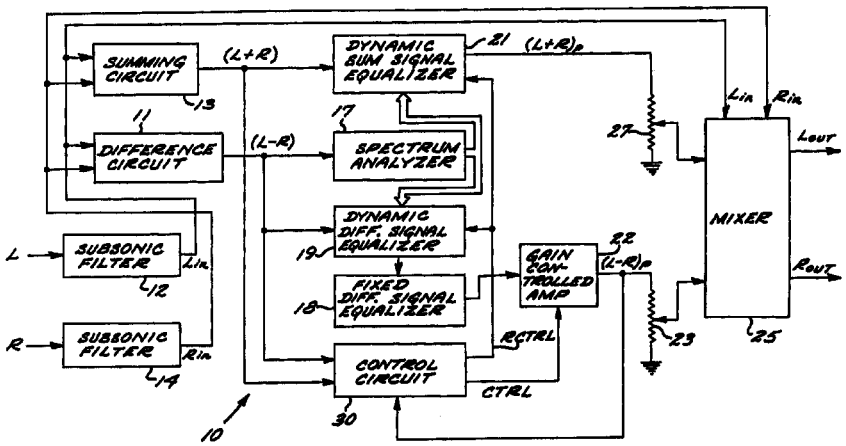

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–16, 28–41, 45–76, 78–86, 91–104, 109–144 and 149–159 is confirmed.

Claims 17–22, 42–44, 77 and 87–89 are cancelled.

Claims 23, 90, 105, 107, 145 and 148 are determined to be patentable as amended.

Claims 24–27, 106, 108, 146 and 147, dependent on an amended claim, are determined to be patentable.

23. [The] *A* stereo enhancement system [of claim 18] *for use with a stereo sound reproduction system having respective left and right signals, comprising:*

*means for providing the difference between the left and right signals as a difference signal and for providing the sum of the left and right signals as a sum signal;*

*processing means responsive to said sum and difference signals for selectively altering the relative amplitudes of components of said difference signal so as to boost selected difference signal components relative to other difference signal components to provide a processed difference signal, and for selectively altering the relative amplitudes of components of said sum signal so as to boost selected sum signal components relative to other sum signal components to provide a processed sum signal;*

*means for combining said processed sum and difference signals and the left and right signals to provide processed left and right signals;*

*wherein said processing means comprises:*

*first equalizing means for selectively attenuating difference signal components so as to attenuate frequencies that statistically include louder components more than frequencies that statistically include quieter components; and*

*second equalizing means for selectively passing sum signal components within a predetermined frequency range which statistically includes said louder difference signal components, and for attenuating sum signal components outside said predetermined frequency range; and*

*control means for amplifying said selectively passed sum signal to provide said processed sum signal and for amplifying said selectively attenuated difference signal to provide said processed difference signal,* wherein said processing means is effective to boost artificial reverberation in said difference signal, and wherein said control means monitors the relative magnitudes of said sum signal and said difference signal to detect conditions indicative of the presence of artificial reverberation, and further filters said amplified difference signal to compensate for said boost of artificial reverberation.

90. A method of making a stereo sound recording, corrected for perspective, from left and right stereo source signals comprising the steps of:

electronically combining left and right stereo source signals to provide sum and difference signals, equalizing said sum signal within predetermined frequency bands to provide a processed sum signal, said equalizing comprising the steps of selectively attenuating said sum signal within said predetermined frequency bands by amounts corresponding to the average response of the human ear to front sounds diminished by the average response of the human ear to side sounds, combining said selectively attenuated sum signal with said difference signal *and with said left stereo source signal* to provide *a* left [and right] perspective corrected output signal[s] *and combining said selectively attenuated sum signal with said difference signal and with said right stereo source signal to provide a right perspective corrected output signal*, feeding said left and right perspective corrected output signals to an apparatus for making a stereo sound recording, and operating said apparatus to make a stereo sound recording.

105. A stereo sound recording adapted to generate signal responses in a stereo player that is used in conjunction with a pair of speakers to cause the speakers to produce enhanced stereo sound, said sound recording comprising:

a record medium having signal producing means adapted to act on a sound recording responsive device of a stereo player to cause the sound recording responsive device to produce left and right stereo output signals that are modifications of left and right stereo source signals and that are comprised of a combination of the following components:

(*a*) components of left and right stereo source signals;

([a]*b*) a perspective sum signal component representing the sum of *said* left and right stereo source signals, and ([b]*c*) a perspective difference signal component representing the difference between *said* left and right stereo source signals, said perspective sum signal component having subcomponents thereof attenuated by amounts corresponding to the statistical average of response of the human ear to front sounds diminished by the statistical average response of the human ear to side sounds.

107. A stereo sound recording adapted to generate signal responses in a stereo player that is used in conjunction with a pair of speakers to cause the speakers to produce enhanced stereo sound, said sound recording comprising:

a record medium having signal producing means adapted to act on a sound recording responsive device of a stereo player to cause the sound recording responsive device to produce left and right stereo output signals that are modifications of left and right stereo source signals and that are composed of a combination of the following components:

(*a*) components of left and right stereo source signals;

([a]*b*) a perspective sum signal component representing the sum of left and right stereo source signals, and ([b]*c*) a perspective difference signal component representing the difference between *said* left and right stereo source signals, said perspective difference signal component having subcomponents boosted by amounts corresponding to the statistical average of response of the human ear to side sounds diminished by the statistical average of response of the human ear to front sounds.

145. A stereo enhancement system having sum and difference signals derived from left and right stereo signals, comprising:

processing means responsive to said sum and difference signals for selectively altering the relative amplitudes of components of said difference signal so as to boost lower and higher frequency difference signal components relative to other difference signal components to provide a processed difference signal, and for selectively altering the relative amplitudes of components of said sum signal so as to boost selected sum signal components relative to other sum signal components to provide a processed sum signal, and means responsive to said processed sum and difference signals to provide *a* left [and right] stereo output [signals] *signal which comprises portions of said left input signal, said processed sum signal and said processed difference signal, and a right stereo output signal which comprises portions of a right input signal, said processed sum signal and said processed difference signal.*

148. [The] *A* stereo enhancement system [of claim 145 including] *having sum and difference signals derived from left and right stereo signals, comprising:*

*processing means responsive to said sum and difference signals for selectively altering the relative amplitudes of components of said difference signal so as to boost lower and higher frequency difference signal components relative to other difference signal components to provide a processed difference signal, and for selectively altering the relative amplitudes of components of said sum signal so as to boost selected sum signal components relative to other sum signal components to provide a processed sum signal;*

*means responsive to said processed sum and difference signals to provide left and right stereo output signals; and* means for monitoring the relative magnitudes of said sum and difference signals to detect conditions indicative of the presence of artificial reverberation, and for modifying said processed difference signal to compensate for effects of artificial reverberation.

* * * * *